US008944535B2

(12) United States Patent
Becchio et al.

(10) Patent No.: US 8,944,535 B2
(45) Date of Patent: Feb. 3, 2015

(54) SYSTEM FOR CONTROLLING THE CLOSING OF A DOOR OF A HOUSEHOLD APPLIANCE, IN PARTICULAR FOR A WASHING MACHINE, SUCH AS A DISHWASHER

(71) Applicant: Elbi International SpA, Turin (IT)

(72) Inventors: Marco Becchio, Turin (IT); Paolo Da Pont, Turin (IT); Michele Farano, Turin (IT); Paolo Ravedati, Turin (IT)

(73) Assignee: Elbi International SpA, Turin (IT)

( * ) Notice: Subject to any disclaimer, the term of this patent is extended or adjusted under 35 U.S.C. 154(b) by 0 days.

(21) Appl. No.: 13/948,764

(22) Filed: Jul. 23, 2013

(65) Prior Publication Data

US 2014/0132135 A1 May 15, 2014

(30) Foreign Application Priority Data

Jul. 23, 2012 (IT) ..... TO2012A0642

(51) Int. Cl.
*A47B 95/02* (2006.01)
*A47L 15/48* (2006.01)
(Continued)

(52) U.S. Cl.
CPC ..... *A47L 15/488* (2013.01); *A47L 15/0034* (2013.01); *A47L 15/4259* (2013.01); *E05B 47/0009* (2013.01); *E05B 63/24* (2013.01); *E05B 17/0037* (2013.01); *E05Y 2900/304* (2013.01); *A47L 2401/20* (2013.01); *A47L 2501/22* (2013.01); *E05Y 2201/426* (2013.01); *E05C 17/56* (2013.01)
USPC ..... 312/319.8

(58) Field of Classification Search
USPC ..... 312/222, 228, 319.1, 319.5, 319.8, 312/326–329
See application file for complete search history.

(56) References Cited

U.S. PATENT DOCUMENTS 5,881,746 A * 3/1999 Buser et al. ..... 134/58 D
7,896,972 B2 * 3/2011 Berends et al. ..... 134/18
(Continued)

FOREIGN PATENT DOCUMENTS

DE 24 05 143 8/1975
DE 10 2005 028448 12/2006
(Continued)

OTHER PUBLICATIONS

Italian Search Report for IT Application No. TO20120642 mailed Feb. 20, 2013 (8 pages).

*Primary Examiner* — Matthew Ing
(74) *Attorney, Agent, or Firm* — Merchant & Gould P.C.

(57) ABSTRACT

A system (10, 110) includes an engagement element (11) mounted on a household appliance (W) door (D). A supporting body (12) is releasably held by a retaining element (16) mounted on a cabinet (C). A striker (14, 114) releasably couples to the retaining element (16) and moves between retracted and extracted positions. When the striker (14; 114) is retracted the door (D) is fully closed, and when extracted the door is pre-opened relative to the cabinet (C). An actuator (20) controls a locking mechanism (18) that tends to switch from an unlocked condition, allowing the striker (14,114) to move from the retracted to the extracted position, to a locked condition, holding the striker (14, 114) in the retracted position. A thrust member (19, 119) exerts thrust on the door (D), facilitating switching to pre-opened when the striker (14) couples to the retaining element (16), locking the locking mechanism (18).

19 Claims, 14 Drawing Sheets

(51) Int. Cl.

| | |
|---|---|
| ***A47L 15/00*** | (2006.01) |
| ***A47L 15/42*** | (2006.01) |
| ***E05B 47/00*** | (2006.01) |
| ***E05B 63/24*** | (2006.01) |
| ***E05B 17/00*** | (2006.01) |
| *E05C 17/56* | (2006.01) |

(56) References Cited

U.S. PATENT DOCUMENTS

| | | | | |
|---|---|---|---|---|
| 8,454,102 | B2 * | 6/2013 | Kim | 312/405 |
| 2011/0016907 | A1 * | 1/2011 | Kang et al. | 62/449 |
| 2011/0036383 | A1 * | 2/2011 | Tiekoetter et al. | 134/57 DL |
| 2011/0279004 | A1 * | 11/2011 | Assmann et al. | 312/228 |
| 2014/0077671 | A1 * | 3/2014 | Dirnberger et al. | 312/228 |

FOREIGN PATENT DOCUMENTS

| | | |
|---|---|---|
| WO | WO 2009/146874 | 10/2009 |
| WO | WO 2011/141542 | 11/2011 |

* cited by examiner

SYSTEM FOR CONTROLLING THE CLOSING OF A DOOR OF A HOUSEHOLD APPLIANCE, IN PARTICULAR FOR A WASHING MACHINE, SUCH AS A DISHWASHER

This claims benefit of Serial No. TO 2012 A 000642, filed 23 Jul. 2012 in Italy and which application is incorporated herein by reference. To the extent appropriate, a claim of priority is made to the above disclosed application.

TECHNICAL FIELD

The present invention relates to a system for controlling the closing of a door of a household appliance, in particular for a washing machine, such as a dishwasher.

BACKGROUND ART

In the field of household appliances, measures must be taken in order to allow closing an inner chamber obtained in a cabinet of such appliances, which typically consists of a wash chamber of a washing machine, such as a dishwasher. In this regard, a door is employed which is movable relative to the cabinet in a manner such as to open or close an access opening, through which the inner chamber can communicate with the environment outside the household appliance.

Generally, such systems comprise an engagement element mounted on either one of said cabinet or said door, and a retaining element mounted on the other one of the door and the cabinet. The retaining element is adapted to releasably retain the engagement element, so as to constrain the door to the cabinet when the household appliance is in use.

The coupling between the engagement element and the retaining element is typically accomplished by a user, who causes them to abut against each other by manually pushing the door against the cabinet until it fully closes. The decoupling between the engagement element and the retaining element is also accomplished by the user, who operates suitable control interfaces (e.g. provided on the front wall of the door or on the front or top face of the cabinet) to activate internal mechanisms of the retaining element in order to disengage the engagement element from the retaining element.

BRIEF DESCRIPTION OF THE INVENTION

It is one object of the present invention to provide a system for closing a door of a household appliance which offers improved performance while at the same time being manufactured in a simple and economical manner.

It is another object of the present invention to provide a system for closing a door of a household appliance which allows to pre-open the door in an automatic and safe manner, so as to put the wash chamber in fluidic communication with the outside environment through the access opening. This device proves to be particularly advantageous in washing machines, e.g. dishwashers, because it allows the steam generated during the wash cycle to escape into the outside environment, thereby contributing to at least partially drying the items contained in the wash chamber.

BRIEF DESCRIPTION OF THE DRAWINGS

Further features and advantages of the present invention will become apparent from the following detailed description, which is supplied by way of non-limiting example with reference to the annexed drawings, wherein.

DETAILED DESCRIPTION OF THE INVENTION

Figure 1:
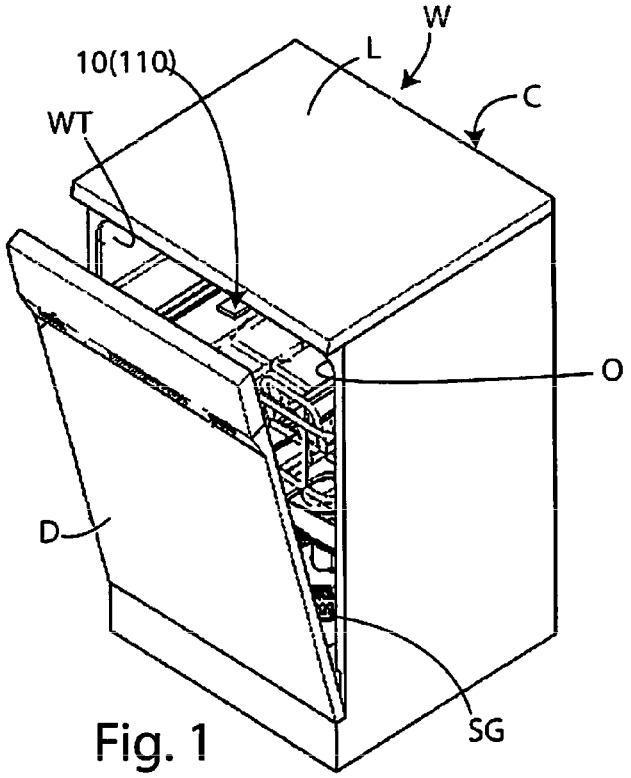
FIG. 1 is a perspective view of a dishwasher incorporating a system for controlling the closing of a door of a household appliance in accordance with a first exemplary embodiment of the present invention.

With particular reference to FIG. 1, W designates as a whole one example of a washing machine subject to installation of a first and, respectively, a second exemplary embodiments of a system 10, 110 according to the present invention. The washing machine is a dishwasher W yet, as will become apparent from the present description, system 10, 110 may also be applied to different washing machines or to other household appliances.

With particular reference to FIG. 1, dishwasher W has a cabinet C in which a wash tub or chamber WT is defined, which is adapted to receive the crockery to be washed. Wash tub WT has an access opening O, through which it communicates with the outside environment and can therefore receive the crockery. In addition, dishwasher W has a door D adapted to open (FIG. 1) and close (FIG. 2) access opening O.

Access opening O is provided on a front face of cabinet C and, preferably, door D is tiltably mounted relative to cabinet C, e.g. being hinged under the latter to a horizontal axis. In the embodiments shown, access opening O has a peripheral sealing gasket SG that allows wash tub WT to be closed fluid-tight when door D is in a fully closed condition.

In the illustrated embodiments, cabinet C has a lid L, which is advantageously situated on the top of said cabinet C.

Figure 2:
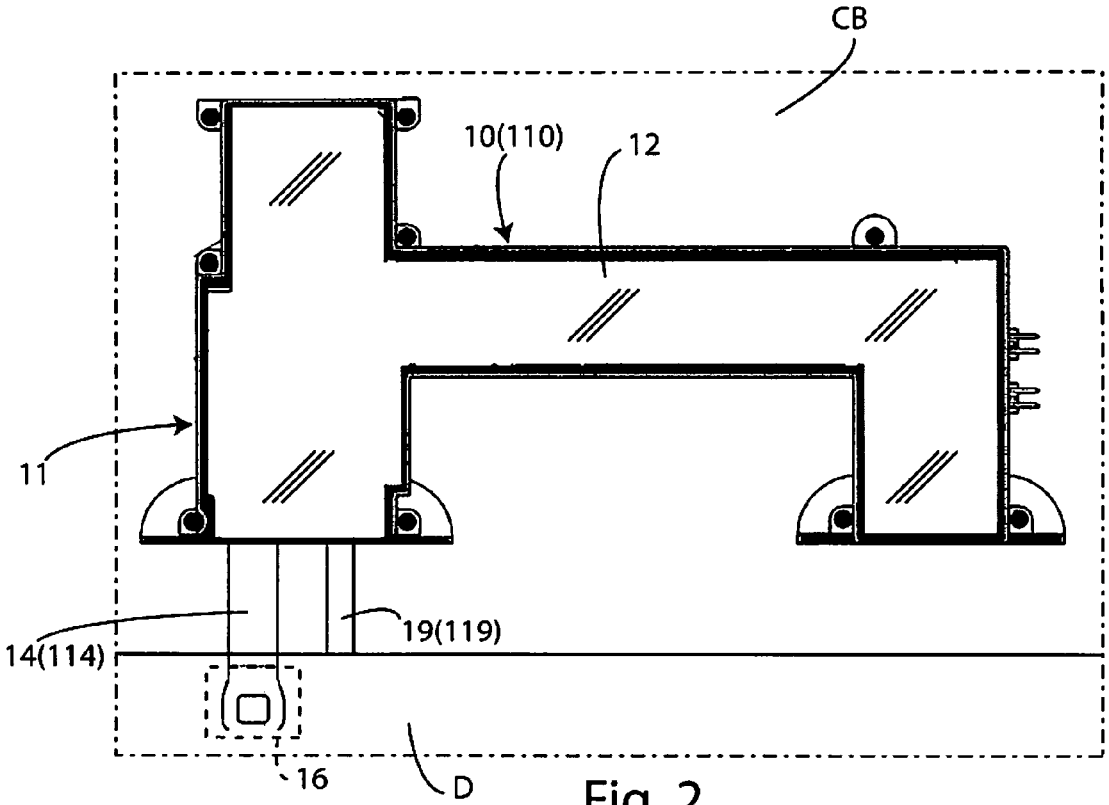
FIG. 2 is a partial schematic top view of the dishwasher of FIG. 1, which is shown without the lid and with the door in the fully closed position.

In FIG. 2, washing machine W is shown only partially without lid L which is typically present on the top of cabinet C. Machine W preferably has a crossbar CB situated on a wall of wash tub WT.

With particular reference to FIGS. 3 to 7, there is shown a first embodiment of system 10 according to the present invention.

The system is adapted to allow closing door D of dishwasher W, and comprises an engagement element 11 to be mounted on cabinet C, e.g. to crossbar CB positioned between cabinet C and lid L. Engagement element 11 is adapted to be releasably held by a retaining element 16 to be mounted on door D, e.g. on the rear face thereof facing towards access opening O.

Retaining element 16 is adapted to releasably retain engagement element 11, so as to constrain door D to cabinet C when dishwasher W is in use. In the illustrated embodiments, engagement element 11 is mounted on cabinet C and retaining element 16 is mounded on door D.

Engagement element 11 comprises a supporting body 12 which, in the illustrated embodiments, is secured to cabinet C, and a striker 14 associated with supporting body 12 and adapted to be releasably coupled to retaining element 16 mounted on door D, so as to constrain door D to cabinet C when dishwasher W is in use. In both of the illustrated embodiments, supporting body 12 is designed as an internally hollow casing, e.g. including a pair of half-shells or trays 12*a*, 12*b*, which are snap coupled together at their periphery.

In both illustrated embodiments, half-shells 12*a*, 12*b* of supporting body 12 are made of plastic material, e.g. by injection moulding. Preferably, supporting body 12 is screwed to cabinet C of household appliance W, e.g. at cross-bar CB.

Figure 5:
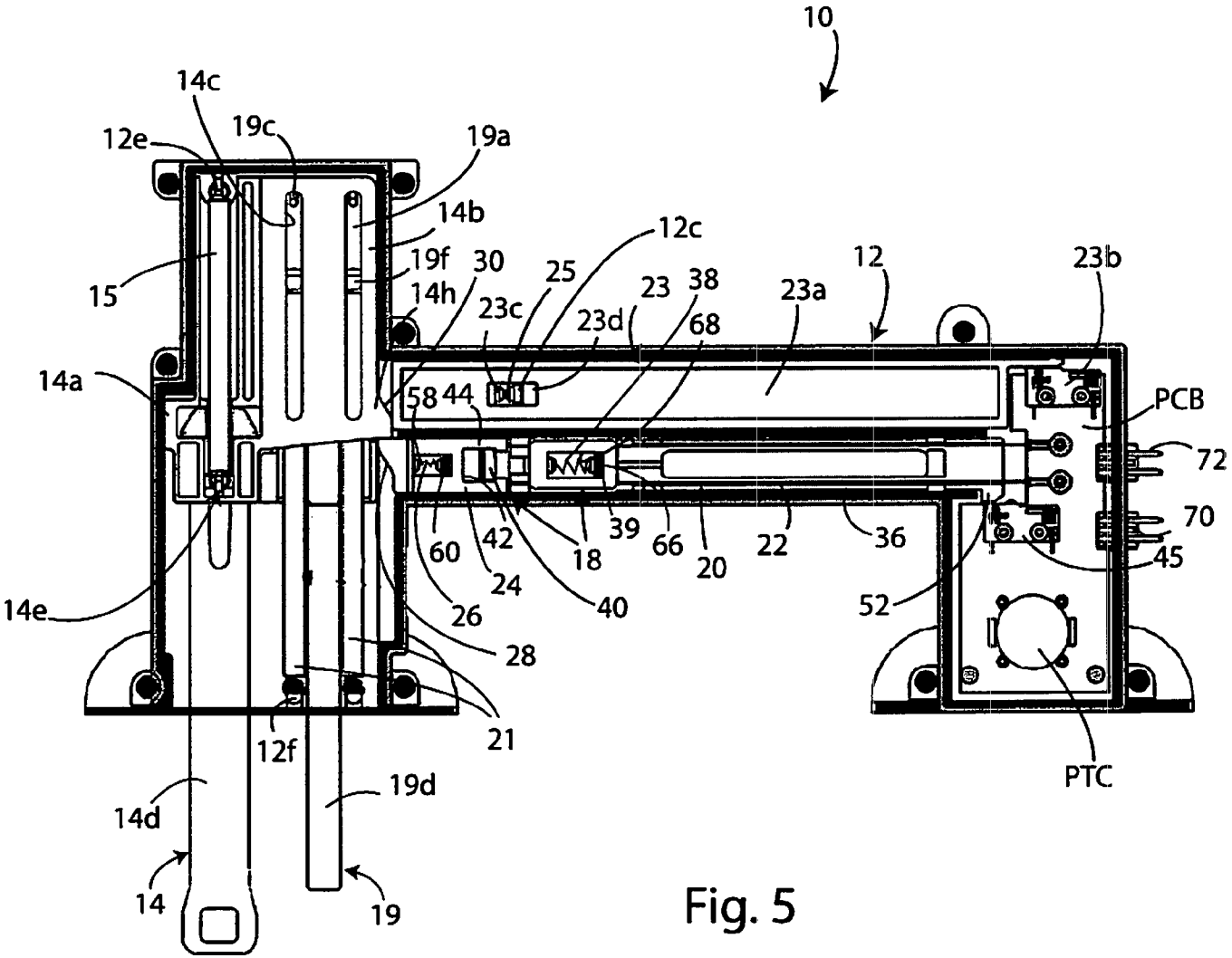
FIGS. 5 to 7 are top views of the system of the preceding figures, shown in a sequence of operating conditions.
Figure 6:
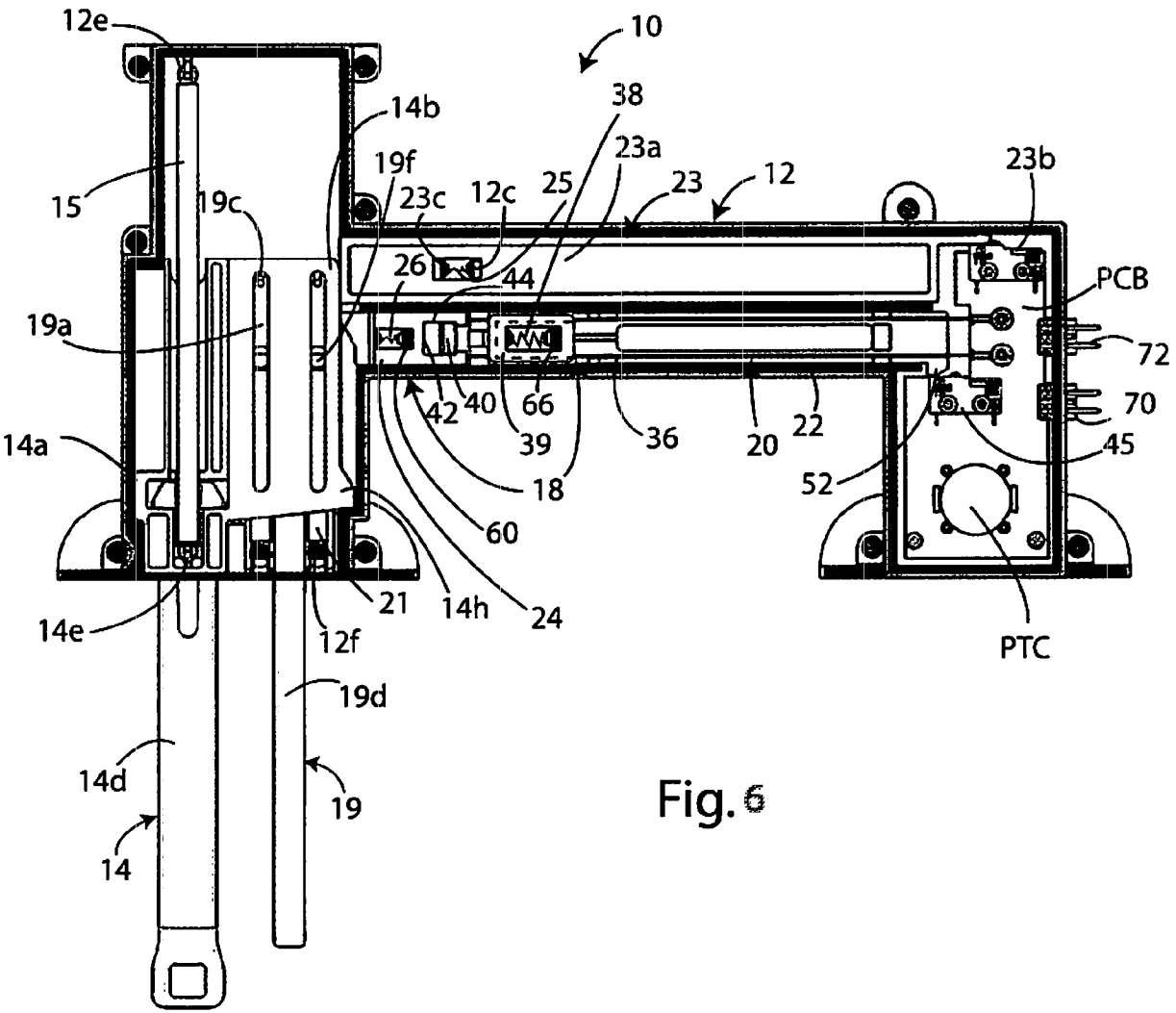

As will become apparent from the following description, striker 14 is movably mounted relative to supporting body 12 between a retracted position (FIGS. 2, 3, 5 and 7) and an extracted position (FIG. 6). Advantageously, the movement of striker 14 is guided by supporting body 12, particularly by inner walls of the latter. Preferably, striker 14 is slideable relative to supporting body 12. In particular, striker 14 is made of plastic material, e.g. by injection moulding.

In both illustrated embodiments, in the retracted position striker 14 partially protrudes from supporting body 12, whereas in the extracted position striker 14 protrudes further out by an additional section. Preferably, striker 14 protrudes through a slot (not numbered) provided on the front face of cabinet C of dishwasher W whereto the whole engagement element 11 has been mounted.

In particular, when striker 14 is coupled to retaining element 16 and moves to the extracted position, retaining element 16 moves away from supporting body 12, which leads to an outward movement of door D, still constrained to cabinet C, which however will no longer be closed fluid-tight at access opening O.

Retaining element 16 is substantially of a per se known type, e.g. with a slotted container body housing an engagement mechanism to which striker 14 can gain access through the slot in order to be releasably coupled to said engagement mechanism. Generally, said engagement mechanism can oscillate between a working position and an idle position, and comprises a swiveling member, the movement of which is countered by an elastic member, and with which the striker 14 is adapted to releasably engage. In the working position, the revolving member of the engagement mechanism holds striker 14 when door D is closed. In the idle position, instead, the revolving member of the engagement mechanism releases striker 14 when the user operates a suitable release mechanism (not shown), e.g. including a push-button, a lever or a knob, located on door D.

Some examples of such a retaining element 16 are widely known in the industry and have been described in detail in many prior-art documents. For completeness' sake, Italian patent applications no. TO97A1120, TO2000A000383 and TO2001A01003 can be mentioned in this regard, the contents of which is to be understood as incorporated herein by way of reference and example. For brevity, therefore, retaining element 16 will not be described any further herein.

When striker 14 is coupled to retaining element 16 and is in the retracted position, engagement element 11 is arranged as shown in FIG. 2, wherein door D is in a fully closed condition, thereby closing fluid-tight access opening O of wash chamber WT. Instead, when striker 14 is coupled to retaining element 16, but is in the extracted position, door D gets into a pre-open condition, since there is a small gap between it and access opening O, which puts wash chamber WT in fluidic communication with the environment outside cabinet C. In particular, in the pre-open condition the steam contained in wash chamber WT (generated, for example, during a wash cycle) can escape from dishwasher W, so that the crockery contained therein will be at least partially dried.

In other words, when striker 14 is coupled to retaining element 16 and moves into the extracted position, it allows retaining element 16 to be moved away from supporting body 12, resulting in door D moving away from cabinet C. Due to the coupling between striker 14 and retaining element 16, door D will remain constrained to cabinet C without however closing access opening O fluid-tight.

Figure 4:
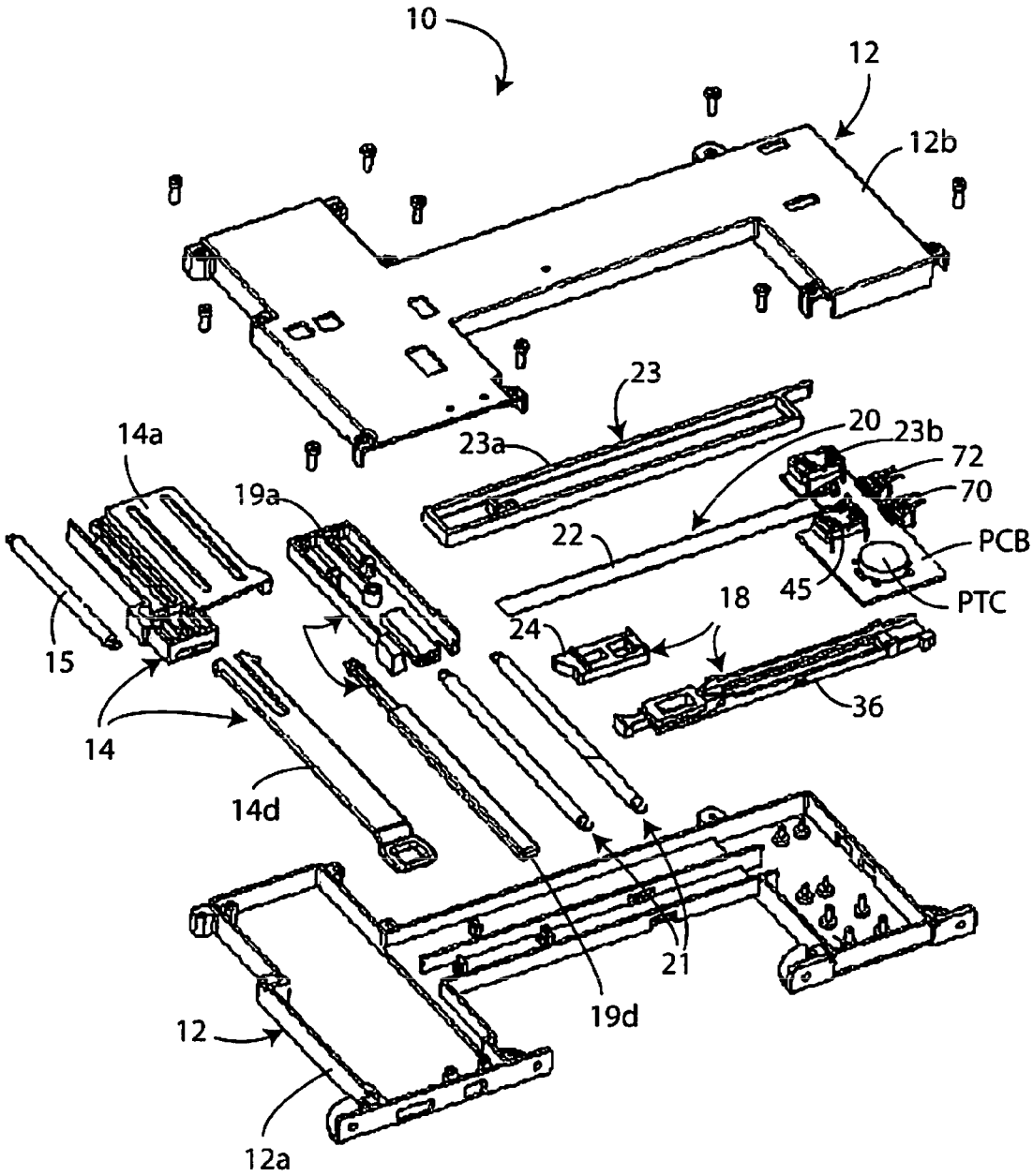
FIG. 4 is an exploded perspective view of the system shown in the preceding figures.

With particular reference to FIGS. 4 and 5, engagement element 11 further comprises a locking mechanism, designated as a whole 18. In both of the illustrated embodiments, locking mechanism 18 is mounted on supporting body 12; in particular, it is contained in the cavity defined by supporting body 12 itself.

locking mechanism 18 tends to switch from an unlocking condition (FIG. 6), in which it is adapted to allow releasing striker 14, allowing the latter to move from the retracted position to the extracted position when striker 14 is coupled to retaining element 16, to a locking condition (FIGS. 3, 5, 7), in which it is adapted to allow holding striker 14 when striker 14 is in the retracted position.

Furthermore, engagement element 11 comprises electrically controlled actuator means 20 adapted to control the switching of locking mechanism 18 from the locking condition to the unlocking condition. For example, said switching occurs when actuator 20 is energized by an electric current flowing therethrough.

In the illustrated embodiments, actuator 20 is connected to an external control unit associated with the household appliance W and capable of supplying electric current to actuator 20 in predetermined conditions of use. In both of the illustrated embodiments, actuator means 20 are mounted on supporting body 12, e.g. housed in the cavity defined within the latter.

Preferably, engagement element 11 further comprises return means 15 adapted to optionally return striker 14 into the retracted position when said striker 14 is decoupled from retaining element 16. In particular, return means 15 are mounted on supporting body 12. This prevents striker 14 from protruding excessively—possibly jeopardizing the users' safety—from cabinet C of dishwasher W when a user decouples striker 14 from retaining element 16 by operating suitable release mechanisms provided on dishwasher W to move door D from the pre-open condition to the fully open condition.

More preferably, the return means comprise elastic return means, e.g. comprising a return spring 15. In particular, elastic return means 15 are adapted to operate by traction.

System 10 further comprises a thrust member 19 capable of exerting a thrust on door D in the direction of movement of striker 14 from the retracted position to the extracted position, thus facilitating the switching of door D into the pre-open condition when striker 14 is coupled to retaining element 16 and locking mechanism 18 is in the unlocking condition. In this manner, the switching of door D from the fully closed condition to the pre-open condition is made easier and more reliable.

In the illustrated embodiment, the use of thrust member 19 makes it possible to optionally adopt return means 15 associated with striker 14. In fact, when door D is in the fully closed condition, the movement of striker 14 from the retracted position to the extracted position takes place against the action of return means 15. Although such movement may tendentially be promoted by the weight of door D (which is connected to striker 14 via the coupling with retaining element 16) and, possibly, by the elastic compression load exerted by gasket SG compressed between door D and cabinet C, it may however risk to be significantly hindered or even prevented by return means 15. Thanks to the presence of the thrust member, instead, the action of return means 15 can be effectively countered because thrust member 19 prevents return means 15 from keeping door D from oscillating when locking mechanism 18 switches to the unlocking condition.

In particular, if return means 15 are present, the return force exerted by them is advantageously smaller than the thrust force exerted by thrust member 19.

Engagement element 11 preferably includes said thrust member 19, e.g. substantially elongated in shape, which is movably mounted relative to supporting body 12 so as to exert said thrust, thus switching from a retracted condition to an extracted condition. This allows to obtain a compact configuration of system 10 by integrating thrust member 19 into the structure of engagement element 11.

In particular, in the retracted condition only a small section (or none at all) of thrust member 19 protrudes from supporting body 12, whereas in the extracted condition thrust member 19 protrudes further out by an additional length.

Advantageously, thrust member 19 is housed within the supporting body 12 and slides relative to the latter, e.g. being guided by inner walls of said supporting body 12.

In both of the illustrated embodiments, engagement element 11 further comprises elastic stressing means 21 acting upon thrust member 19 and tending to bring it into the extracted condition.

Preferably, system 10 further comprises elastic stressing means 21 acting upon said thrust member 19 and tending to bring it into the extracted condition. In both of the illustrated embodiments, elastic stressing means 21 are mounted between supporting body 12 and thrust member 19, and are adapted, for example, to operate by traction, pulling thrust member 19 outwards from the supporting body. Advantageously, the elastic stressing means comprise at least one traction spring 21; in the illustrated embodiments a pair of traction springs 21 are employed.

In both of the illustrated embodiments, striker 14 and thrust member 19 are movable in parallel directions.

Preferably, striker 14 and thrust member 19 are mounted to each other in a mutually guided manner, particularly in a slideable fashion.

More preferably, striker 14 and thrust member 19 are mutually integral with each other while sliding from the respective retracted position or condition to the respective extracted position or condition, when striker 14 is coupled to said retaining element 16 and locking mechanism 18 releases at least one of striker 14 and thrust member 19, thereby switching from the locking condition to the unlocking condition. This is particularly useful to avoid that, while striker 14 is moving from the retracted position to the extracted position, thrust member 19 and door D (the position of which depends on the position of striker 14 because of the connection still existing between engagement element 11 and retaining element 16) might get into mutual positions not allowing a correct thrust action towards the pre-open position. In the illustrated embodiments, thrust member 14 is made slidable as a unit with striker 19 by striker 14 resting on thrust member 19.

Advantageously, striker 14 can slide relative to thrust member 19 along at least a part of the travel from the extracted position to the retracted position, under the control of said return means 15, when striker 14 and the retaining element are decoupled. In the first embodiment shown herein, striker 14 is slideable from the extracted position to the retracted position independently of the movement of thrust member 19.

Figure 4A:
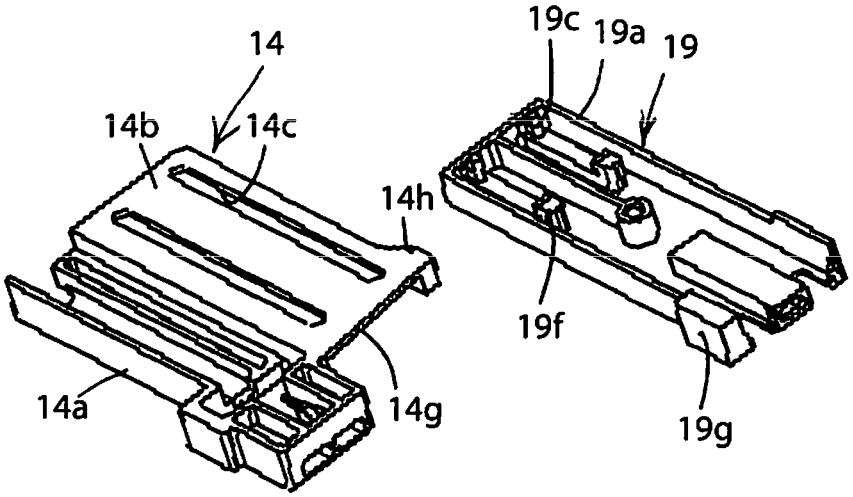
FIG. 4*a* is a perspective view of a set of components of the system shown in FIG. 4.

In both embodiments, striker 14 and thrust member 19 have reciprocal proximal slides 14*a* and 19*a* which cooperate with each other to provide the guided sliding action explained above. In this first embodiment, proximal slide 14*a* has a transversal extension 14*a* in which proximal slide 19*a* is slideably mounted, advantageously in a "drawer-like" fashion, in the axial direction between the retracted condition and the extracted condition of thrust member 19. With particular reference to FIG. 4*a*, transversal extension 14*b* has suitable slots 14*c* extending in the axial direction, within which complementary protrusions can slide, e.g. pegs 19*c*, carried by proximal slide 19*a*.

In both embodiments, striker 14 and thrust member 19 have reciprocal distal appendices 14*d* and 19*d* mounted on proximal slides 14*a* and 19*a* and adapted to protrude outwards from supporting body 12 (through front slots or apertures formed in the latter), so as to cooperate with said retaining element 16 and said door D. Particularly, each distal appendix 14*d* and 19*d* has a pair of connection legs which can be elastically stretched apart and coupled by interference into suitable slots (not numbered, but distinctly visible in FIG. 4*a*) formed at the front in proximal slides 14*a* and 19*a*.

In the illustrated embodiments, unlike distal appendices 14*d* and 19*d*, proximal portions 14*a* and 14*b* are advantageously always contained within the housing defined by supporting body 12, without protruding externally thereto during the movement of striker 14 and of thrust member 19.

In this first embodiment illustrated herein, return spring 15, which advantageously operates by traction, is mounted between a peg 14*e* carried by striker 14, in particular by proximal slide 14*a*, and a respective peg 12*e* carried by supporting body 12.

In both of the illustrated embodiments, each stressing spring 21, which advantageously operates by traction, is mounted between a respective peg 19*f* carried by proximal slide 19*a* and a respective peg 12*f* carried by supporting body 12.

Particularly, if return spring 15 is present, the force exerted by it on striker 14 is advantageously smaller than the force exerted by stressing springs 21 on thrust member 19.

In the illustrated embodiments, the respective proximal portions 14*a* and 19*a* have respective shoulders 14*g* and 19*g* adapted to abut against each other while switching from the respective retracted position or condition to the respective extracted position or condition. In particular, shoulder 14*g* is adapted to abut against shoulder 19*g* in order to keep, when in use, thrust member 19 in abutment with door D, so as to exert an optimal thrust towards the pre-open position.

By way of example, the shoulder of striker 14 is defined by an upper corner 14*g* brought into an axially forward position by transversal extension 14*b*, whereas the shoulder of thrust member 19 is defined by a tooth 19*g* protruding upwards from proximal portion 19*a* in an axially forward position of the latter.

Of course, as striker 14 returns into the retracted position, the abutment between shoulders 14*g* and 19*g* is resolved, thus making independent the position of striker 14 along thrust member 19.

Preferably, locking mechanism 18 is adapted to constrain at least one of striker 14 and thrust member 19, thus preventing it from moving to the extracted position and, respectively, to the extracted condition when striker 14 and/or thrust member 19 is in the respective retracted position or condition, and locking mechanism 18 is in the locking condition.

In this manner, locking mechanism 18 can be designed with different possible configurations, since it can be structured for:

acting directly upon striker 14, thus preventing door D from moving away from cabinet C against the action of thrust member 19, and/or acting directly upon thrust member 19, thus inhibiting the thrust against door D required for striker 14 to move, allowing oscillation in the pre-open position; in this case, however, it is preferable that thrust member 19 cooperates with striker 14 to prevent the latter from moving until thrust member 19 is in the retracted condition, locked by locking mechanism 18 (e.g. as it happens in the second embodiment of the present invention).

Preferably, locking mechanism 18 is adapted to operate in a transversal direction relative to the direction of movement of striker 14 and/or of thrust member 19.

In this first embodiment, locking mechanism 18 is adapted to act upon striker 14, in particular by releasing or holding a transversal protrusion 14*h* carried by striker 14, e.g. by transversal extension 14*b*.

Preferably, system 10 comprises sensing means 23 adapted to detect the extracted position or condition of at least one of striker 14 and thrust member 19. This allows to obtain an indirect indication about the state of door D in operation. In this first embodiment, the sensing means are adapted to monitor the position of striker 14, and are therefore adapted to provide an indication about the fact that striker 14 is in the extracted position—and hence door D is in the pre-open condition.

Advantageously, sensing means 23 comprise a mobile element 23*a*, movable relative to said supporting body 12 in a manner controlled by at least one of striker 14 and thrust member 19, and a sensitive member 23*b*, which is adapted to provide an indication about the position taken by mobile element 23*a*.

For example, mobile element 23*a* can be moved in a guided manner from supporting body 12, in particular in a transversal direction relative to the direction in which striker 14 or thrust member 19 is adapted to move. Advantageously, mobile element 23*a* is housed within the casing formed by supporting body 12. Preferably, the mobile element is a cursor 23*a*, which on one side cooperates with striker 14 or with thrust member 19, and on the other side cooperates with sensitive member 23*b*.

For example, the sensitive member is a switch 23*b*, particularly a microswitch, adapted to be operated by mobile element 23*a*, e.g. by an appendix (not numbered) carried by mobile element 23*a* and capable of activating switch 23*b* according to predetermined criteria.

Preferably, mobile element 23*a* is adapted to be pushed in abutment with at least one of striker 14 and thrust member 19 through the effect of elastic countering means 25. More in detail, the action of elastic countering means 25 takes place in a manner such that mobile element 23*a* is brought from a normally idle condition (FIGS. 3, 5 and 7), in which it does not actuate sensitive member 23*b* when striker 14 and/or the thrust member are in the retracted position or condition, to an active condition (FIG. 6), in which it actuates sensitive member 23*b* when striker 14 and/or thrust member 21 are in the extracted position or condition. In this first embodiment illustrated herein, mobile element 23*a* is associated and pushed by striker 14, e.g. by transversal protrusion 14*h*, which tends to push it towards the normally idle condition. When transversal protrusion 14*h*, while the striker is moving towards the extracted position, goes past mobile element 23*a*, the latter can move into the active condition.

For example, mobile element 23*a* may include a lug 23*c*, and the supporting body may have a corresponding lug 12*c*, in turn extending through a slot 23*d* on mobile element 23*a*. Moreover, between lugs 12*c* and 23*c* elastic countering means 25 may be mounted, particularly tending to move said lugs 12*c* and 23*c* away from each other, thereby causing mobile element 23*a* to push against striker 14 and/or thrust member 19.

Preferably, actuator 20 is adapted to switch from a normally extended condition (FIGS. 3, 5 and 7) to a contracted condition (FIG. 6). In the extended condition, actuator 20 allows locking mechanism 18 to get into the locking condition; in the contracted condition, instead, actuator 20 brings locking mechanism 18 into the unlocking condition.

More preferably, actuator 20 comprises a shape-memory conductive element 22 mechanically connected to and cooperating with the locking mechanism. In particular, conductive element 22 is made of a shape memory alloy (SMA) capable of taking a preset shape (in this case corresponding to the shape taken in the contracted condition) following a variation in its temperature which is due, in the illustrated embodiments, to heating through the Joule effect caused by current flowing through it.

In alternative variant embodiments not shown, conductive element 22 may be replaced with different types of electric actuators; in such variants, the actuator may include an electromagnetic actuator (e.g. of the solenoid type) or an electrothermal actuator (e.g. of the wax type). Said types of actuators are per se known in the art and will not therefore be described for the sake of brevity.

As will be described in detail below, in the illustrated embodiments conductive element 22 is provided in the form of a wire mechanically connected to—and acting upon—locking mechanism 18 in order to bring the latter from the normal locking condition to the unlocking condition.

In both of the illustrated embodiments, conductive element 22 is advantageously connected in series to a positive temperature coefficient (PTC) resistor.

Preferably, locking mechanism 18 comprises a slide 24 which can move, in particular slide, relative to supporting body 12 from a locking position (FIGS. 3, 5 and 7) to an unlocking position (FIG. 6). In the locking position, slide 24 is adapted to hold at least one of striker 14 and thrust member 19 when it is in the retracted position and, respectively, in the retracted condition, thereby preventing it from moving to the extracted position and, respectively, into the extracted condition. In the unlocking position, instead, slide 24 allows the movement of at least one of striker 14 (from the retracted position to the extracted position) and thrust member 19 (from the retracted condition to the extracted condition) through the effect of an electric energization of actuator 20. In addition, locking mechanism 18 comprises an elastic member 26 tending to hold slide 24 in the locking position. In the illustrated embodiments, elastic member 26 is interposed between supporting body 12 and slide 24. Preferably, elastic member 26 is a spring, e.g. a compression-preloaded spring, advantageously of the coil type.

In the first embodiment illustrated herein, slide 24 cooperates with striker 14.

Slide 24 is preferably positioned against a protrusion formed transversally in at least one of striker 14 and thrust member 19, when slide 24 is in the locking position and striker 14 or the thrust member is in the retracted position or, respectively, in the retracted condition. In the first embodiment shown herein, said protrusion advantageously coincides with transversal protrusion 14*h* of striker 14.

Therefore, in both of the illustrated embodiments locking mechanism 18 has a substantially ratchet-like property, wherein slide 24 behaves like a ratchet adapted to prevent the movement of at least one of striker 14 and thrust member 19. In particular, when engagement element 11 and retaining element 16 are coupled to each other, striker 14 is subject, on one side, to "extraction" forces due to the thrust force exerted by thrust member 19 and to the weight of door D, possibly assisted by the elastic compression of sealing gasket SG. On the other side, still when engagement element 11 and retaining element 16 are coupled to each other, striker 14 is subject to "retraction" forces due to the action of return means 15 (if present), which forces are generally smaller than the opening forces. Therefore, when locking mechanism 18 is in the locking condition, slide 24 that constrains striker 14 prevents the "extraction" forces from actuating the system to bring door D into the pre-open condition.

With particular reference to FIG. 5, in the first embodiment slide 24 and striker 14 preferably have respective complementary profiles 28 and 30 cooperating with each other. Profiles 28 and 30 are adapted to allow, by interference, the forced displacement of striker 14 from the extracted position to the retracted position, possibly with the contribution of return means 15, thus countering the action of elastic member 26. In this regard, if return means 15 are present, they are so sized as to exert a return force, e.g. an elastic pulling force, having such intensity as to overcome the elastic countering force exerted by elastic member 26.

In the first embodiment shown herein, profiles 28 and 30 are respective inclined sections of projecting noses (not numbered) carried by slide 24 and, respectively, by striker 14, in particular by transversal protrusion 14*h*. The cooperation between profiles 28 and 30 will be described in detail below, jointly with the overall operation of system 10.

In the illustrated embodiments, locking mechanism 18 further comprises a cursor 36 movable by means of actuator 20 and movably, in particularly slideably, mounted relative to supporting body 12 from an idle position (FIGS. 3, 5 and 7) to an active position (FIG. 6). In the idle position, cursor 36 allows slide 24 to move from the unlocking position to the locking position under the action of elastic member 26. In the active position, instead, cursor 36 drags slide 24 from the locking position to the unlocking position against the action of elastic member 26 when actuator 20 is electrically energized. Furthermore, locking mechanism 18 comprises an elastic element 38 tending to hold cursor 36 in the idle position. In the illustrated embodiments, elastic element 38 is mounted between supporting body 12 and cursor 36. Preferably, elastic element 38 is a spring, e.g. a compression-preloaded spring, advantageously of the coil type.

Preferably, cursor 36 is mechanically connected to shape-memory element 22, and is therefore adapted to be dragged by the latter between the idle position and the active position. In the illustrated embodiments, the shape-memory element is provided in the form of a conductive wire 22 connected to cursor 36, e.g. arranged in a U fashion to embrace with its bend a part of cursor 36. Preferably, said conductive wire 22 is wound with its bend along a peripheral section of a prominent portion 39 (which in the illustrated embodiment is a substantially annular portion surrounding an inner cavity into which the elastic element is placed during assembly) of cursor 36, e.g. it is inserted into a perimetric groove (not numbered) formed in said peripheral section.

In the illustrated embodiments, slide 24 and cursor 36 are coupled together with some sliding play. Preferably, the coupling between slide 24 and the cursor is substantially of the so-called "coulisse" type. More preferably, cursor 36 has a mushroom-shaped end 40 and slide 24 has a profiled cavity 42 that houses mushroom-shaped end 40 with some axial play. Even more preferably, mushroom-shaped end 40 has a transversally wider head and a narrower neck which tapers away from the head; in its turn, cavity 42 has a transversally wider proximal portion that houses the head with some axial play, and a transversally narrower distal portion that extends from the proximal portion and allows, through it, the axial sliding of the neck (details not numbered). Advantageously, profiled cavity 42 is defined by a pair of side arms 44 situated at the end of slide 24, which converge transversally inwards at their free ends. For example, each one of side arms 44 defines a substantially hook-like shape. Advantageously, on top of side arms 44, after they have been coupled to head 42, a closing crosspiece (not numbered) is mounted, e.g. by interference fit; this reduces the risk of head 42 undesirably coming out by climbing over side arms 44.

In the illustrated embodiments, elastic element 38 exerts an elastic return force on cursor 36 which is greater than the elastic return force exerted by elastic member 26 on slide 24. In this way, elastic element 38 can effectively return cursor 36 into the active position, in particular by reliably pulling back conductive wire 22 with a high-intensity force. Also, elastic member 26 can thus return slide 24 into the locking position, without however hindering—by exerting excessive resistance—the action of return means 15 (if present), which forcedly return the slide 24 into the retracted position when the user causes the decoupling of striker 14 of engagement element 11 from retaining element 16 by operating a suitable release mechanism provided on door D or on cabinet C.

In the illustrated embodiments, slide 24 and/or cursor are movable in a direction which is substantially transversal, preferably orthogonal, to the direction of movement of striker 14 and/or of thrust member 19 (if present). For example, slide 24 and cursor 36 are movable in the same direction.

Preferably, locking mechanism 18 is adapted to stop the electric energization of actuator 20 after locking mechanism 18 has gone into the unlocking condition. More preferably, the actuator 20 comprises a safety switch 45, e.g. a microswitch, controlled by locking mechanism 18 and adapted to electrically disconnect actuator 20 from the external control unit when locking mechanism 18 gets into the unlocking condition. In the illustrated embodiments, switch 45 is electrically connected downstream of one of the power contacts (not numbered) that allow connecting actuator 20 to the external control unit. For example, power contacts 46 are electrically connected to the ends of conductive wire 22.

Preferably, switch 45 comprises a fixed contact (not numbered) and a mobile contact (not numbered) cooperating with locking mechanism 18 in a manner such that it is moved away from the fixed contact as locking mechanism 18 reaches the unlocking condition. In the illustrated embodiments, the mobile contact has a profiled protrusion adapted to abut against a corresponding protrusion 52 carried by locking mechanism 18, e.g. by cursor 36, so that the mobile contact will detach itself, e.g. by bending, from the fixed contact when locking mechanism 18 reaches the unlocking condition, e.g. when cursor 36 reaches the active position. Preferably, the profiled protrusion of the mobile contact has a cusp-like profile. Also preferably, protrusion 52 has an inclined section substantially conjugated to the cusp-profiled section of the mobile contact.

With particular reference to FIG. 5, elastic member 26 is preferably axially interposed between a lug 58 protruding from slide 24 and a fixed shelf 60 protruding from supporting body 12, e.g. from lower half-shell 12*b*. Preferably, shelf 60 is housed in a guide aperture (not numbered) formed through slide 24. In this manner, elastic member 26 can push lug 58 as a unit with slide 24 until a terminal edge of said guide aperture abuts against fixed shelf 60, which corresponds to the locking position of slide 24. Therefore, fixed shelf 60 also acts as an end-of-travel element for slide 24.

Preferably, cursor 36 is slideable in supporting body 12, being preferably guided by inner walls of supporting body 12, e.g. by walls of lower half-shell 12*b* and by the back walls of both half-shells 12*a* and 12*b*.

Preferably, elastic element 38 is axially interposed between an additional lug (e.g. prominent portion 39), protruding from cursor 36, and an additional fixed shelf 66, protruding from supporting body 12, e.g. from lower half-shell 12*b*. Preferably, additional shelf 66 is housed in an additional guide aperture (not numbered) formed through cursor 36, e.g. in the vicinity of the additional lug (through prominent portion 39 in the illustrated embodiments). In this manner, elastic element 38 can push additional lug 39 as a unit with cursor 36 until a terminal edge of the additional guide aperture 68 abuts against additional fixed shelf 66, which corresponds to the idle position of cursor 36. Therefore, additional fixed shelf 66 also acts as an end-of-travel element for the cursor.

In the illustrated embodiments, switches 23*b* and 45, along with resistor PTC, are carried by a support or board PCB on which a printed circuit is formed which connects said switches and resistor. Advantageously, support PCB has two pairs of connection terminals 70 and 72 adapted to supply electric power to actuator means 20 and to sensing means 23, respectively, e.g. via resistor PTC and switch 23*b*, respectively.

The following will describe the operation of the first embodiment illustrated herein of system 10 according to the present invention.

Reference will initially be made to the configuration of dishwasher W with door D partially open (FIG. 1).

Figure 7:
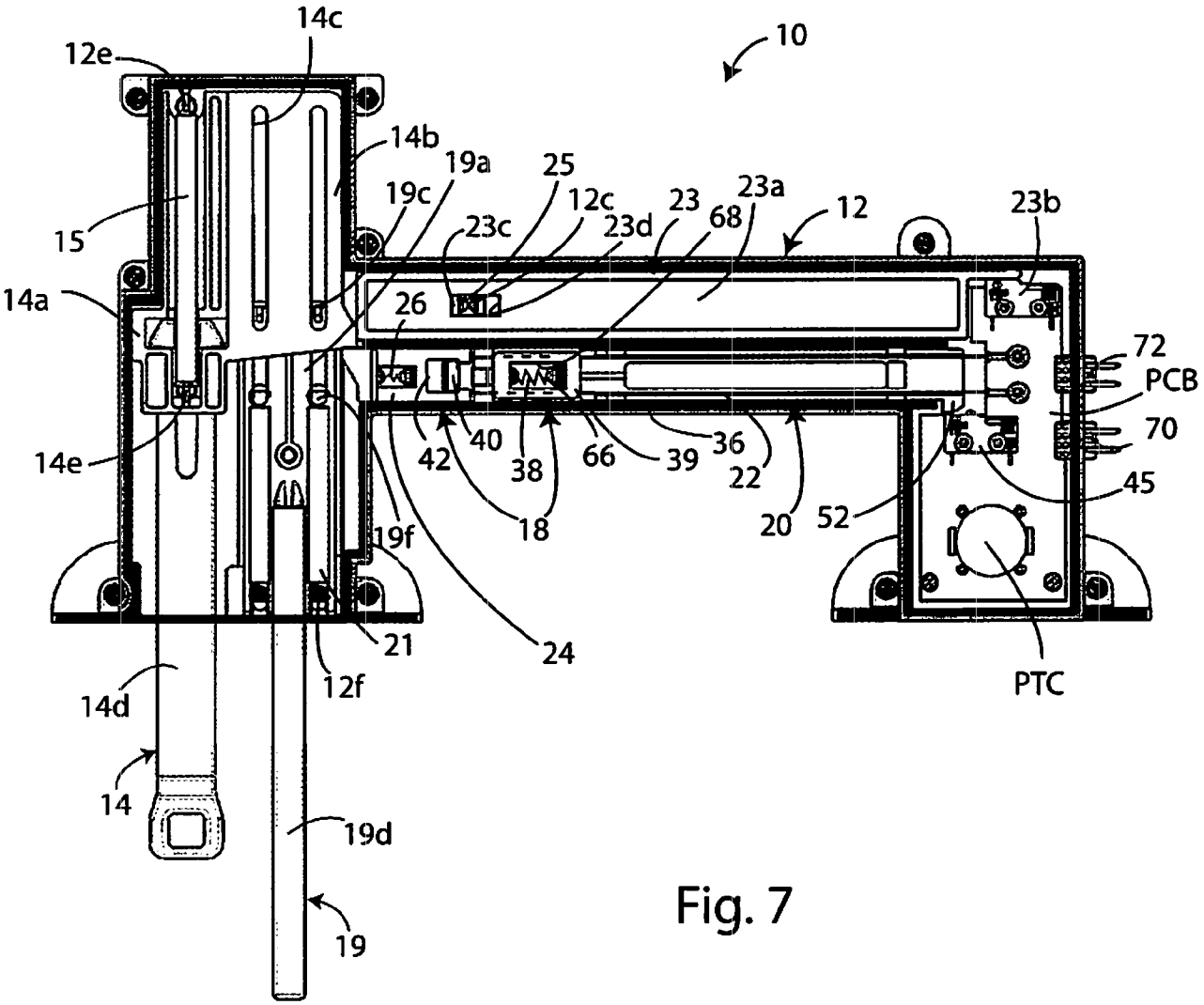

Such a configuration corresponds, in system 10, to the one shown in FIG. 7, wherein engagement element 11 has striker 14 held in the retracted position by return means 15, locking mechanism 18 is arranged in the locking condition, thrust member 19 is held in the extracted condition by stressing means 21, actuator 20 is not electrically energized, and sensing means 23 detect the retracted position of striker 14. More in detail, slide 24 is held in the locking position by elastic member 26, while cursor 36 is held in the idle position by elastic element 38. Furthermore, conductive wire 22 is in the extended condition and is held in traction. Also, protrusion 14*h* abuts against slide 24.

In this situation, with engagement element 11 decoupled from retaining element 16, door D can be opened completely by a user, and crockery to be washed can thus be introduced into wash chamber WT. The user can afterwards program the wash cycle of dishwasher W by using suitable control interfaces typically provided on door D.

Let us now consider the action carried out by the user while closing door D against cabinet C. During this operation, retaining element 16 and striker 14 of engagement element 11 are brought close to each other and coupled together, while at the same time door D pushes thrust member 19 from the extracted condition to the retracted condition, guided by striker 14, in particular by side extension 14*b* (in this first embodiment illustrated herein, through slots 14*c*).

Figure 3:
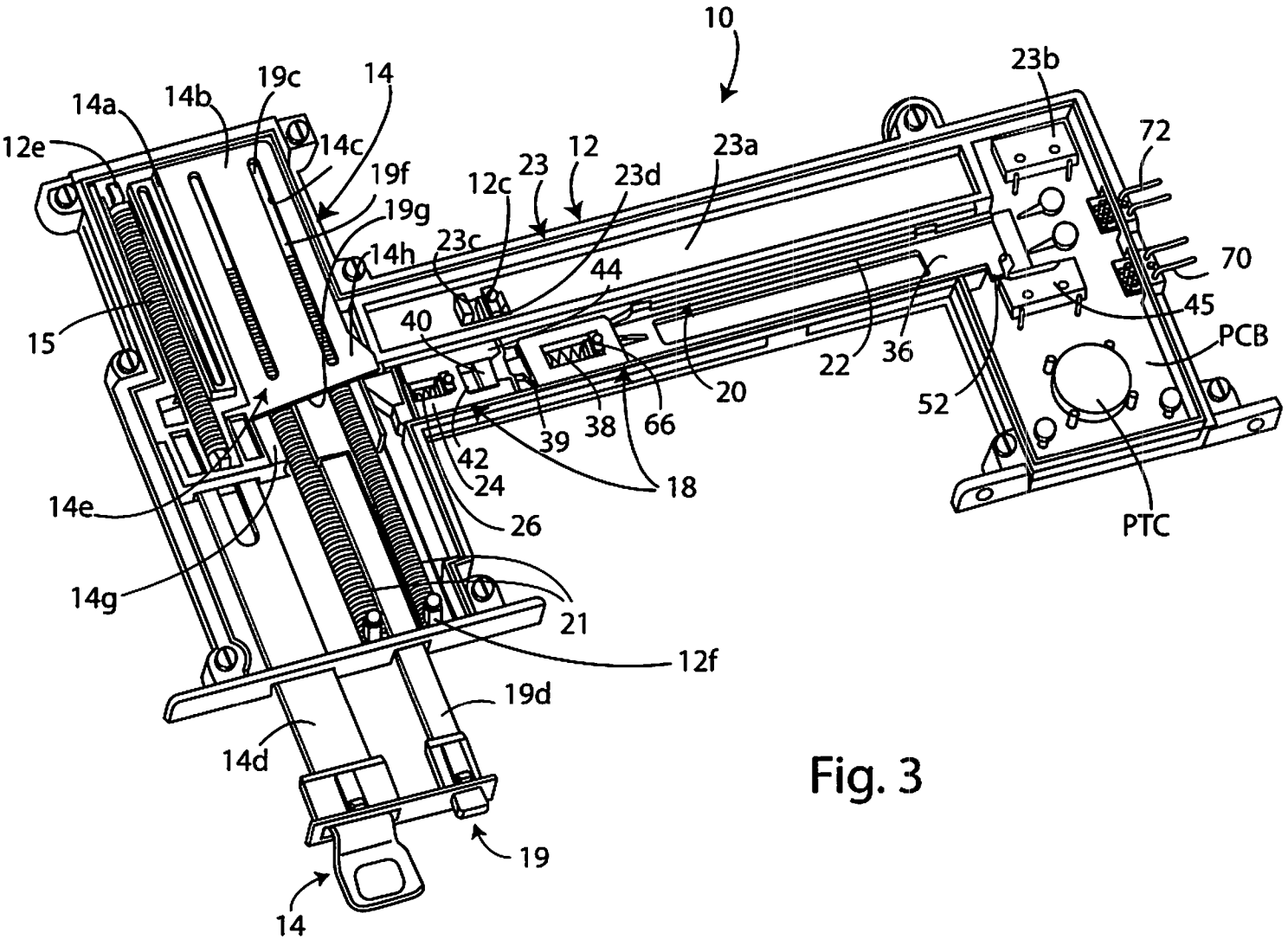
FIG. 3 is a partial perspective view of the system of the preceding figures, which shows some internal components thereof.

After said closing action carried out by the user, door D of dishwasher W will be fully closed and engagement element 11 will be in the configuration shown in FIGS. 2 and 3, coupled to retaining element 16. Note that thrust member 19—in abutment with door D—exerts its action against door D, but cannot cause it to open because striker 14 behaves like a "dead bolt" holding door D in the closed position. In fact, although striker 14 can translate from the retracted position to the extracted position, it is stopped and firmly held in the retracted position by locking mechanism 18, in particular through the effect of the abutment of slide 24 against striker 14 (e.g. against transversal protrusion 14*h*).

In such a fully closed configuration of the door, engagement element 11 has striker 14 in the retracted position, locking mechanism 18 is in the locking condition, thrust member 19 is in the retracted position, actuator means are not electrically energized, and sensing means 23 detect the retracted position of striker 14. More in detail, slide 24 is held in the locking position by elastic member 26, while cursor 36 is held in the idle position by elastic element 38. Furthermore, conductive wire 22 is in the extended or elongated condition.

Therefore, the wash cycle programmed by the user can be automatically activated by the external control unit of dishwasher W.

It should now be considered that, at the end of said wash cycle carried out by washing machine W, the external control unit will send a current impulse to actuator 20, so as to electrically energize it and bring locking mechanism 18 into the unlocking condition.

The flow of electric current causes conductive wire 22 to heat up and rapidly switch from the extended condition to the contracted condition, thus getting shorter and dragging cursor 36 backwards from the idle position to the active position, against the action of elastic element 38 (FIG. 6). Therefore, after a short idle travel (e.g. approx. half millimetre), cursor 36 will drag along slide 24 from the locking position to the unlocking position. More in detail, mushroom-shaped end 40 will abut against the converging ends of side arms 44, thereby causing slide 24 to be dragged backwards.

In the illustrated embodiments, conductive wire 22 is designed to reduce its length by approx. 3.5% while switching from the longer extended condition to the shorter contracted condition.

In this way, striker 14 is free to move into the extracted position (FIG. 6) through the effect of the connection with retaining element 16, which is carried by door D, with the assistance of the thrust member 19. In fact, the thrust member 19 contributes to pushing the door D away from the cabinet C against the retaining action of the return means 15, which act upon the striker 14 and tend to hold it in the retracted position. When the striker 14 and the thrust member 19 are in the extracted position or condition, the respective proximal slides 14*a* and 19*a* abut against the walls of the supporting body 12, e.g. against the perimeter of the lower half-shell 12*a*, so that any undesired excessive travel thereof is prevented.

At this stage, the shoulder 14*g* of the striker 14 advantageously abuts against the shoulder 19*g* of the thrust member 19, so that the striker 14 and the thrust member 19 are made as a unit with each other while moving towards the respective extracted position or condition.

Preferably, the striker 14 and the thrust member 19 are designed to, when they are in the extracted position, protrude further outwards from the supporting body 12 by an extension of a few centimetres (preferably 1 to 3 cm, but in certain conditions of use even more than 5 cm with respect to the normal projection of the striker 14 and of the thrust member 19 when they are in the retracted position or condition); in this way, the movement of the door D away from the access opening O, which is dependent on the above-mentioned extension, will be sufficient to allow the fluidic communication between the wash chamber WT and the environment outside the cabinet C. In the illustrated embodiments, said extension is approx. 5.5 cm.

Furthermore, when the striker 14 goes past the mobile element 23*a*, the sensing means 23 detect the switching of the striker 14 into the extracted position, which in this case is indicative of the fact that the door D has reached the pre-open position.

When the electric current impulse supplied by the external control unit stops, the actuator 20 returns into the electrically de-energized condition and the locking mechanism 18 returns into the locking condition.

At this stage, when the electric current impulse has stopped the conductive wire 22 starts cooling down and gradually returns into the extended condition, thus becoming longer, and, correspondingly, the elastic element 38 progressively pushes the cursor 36 forwards towards the idle position by following the bend of the conductive wire 22, which is extending; in particular, the mushroom-shaped end 40 of the elastic element 38 moves gradually forwards towards the idle position by following the elongation of the conductive wire 22. As a consequence, also the side arms 44 of the slide 24, which had previously been dragged backwards by the cursor 36, will tend to follow the forward movement of the mushroom-shaped head 40 through the action of the elastic member 26, and will gradually return the slide 24 into the locking position.

In the illustrated embodiments, the elastic element 37 has an elastic compression preload of approx. 0.5 kg, and the conductive wire 22 has a diameter of approx. 0.38 mm. The preload of the elastic element 38 is adapted to the diameter of the conductive wire 22, in order that the cursor 36 can be effectively returned into the idle position.

In the illustrated embodiments, the elastic member 26 has an elastic compression preload of approx. 200 g, which is smaller than that of the elastic element. In fact, the main function of the elastic member 26 is to prevent the slide 24 from correctly rearranging itself into the locking position, in particular should the return action exerted on the conductive wire 22 by the elastic element 38 cause any accidental jamming or seizure.

In the illustrated embodiments, the conductive wire 22 is designed to cool down and go back from the shorter contracted condition to the longer extended condition within approx. 13 sec.

Optionally, when the locking mechanism 18 gets into the unlocking condition, it will stop the electric connection between the external control unit and the actuator 20. This measure has been conceived in order to avoid any damage to the conductive wire 22 which might be caused by overheating due to an accidentally excessive duration of the energization current impulse supplied by the external control unit (e.g. caused by said impulse not being interrupted within nominal times). This can be accomplished in different ways.

A first possible way is to use the safety switch 45. More in detail, when the cursor 36 reaches the active position, it interferes with the safety switch, thus opening it and breaking the current flow through the conductive wire 22. In particular, the protrusion 52 of the cursor 36 rests against the profiled protrusion of the mobile contact of the safety switch 45, thereby moving it away from the associated fixed contact.

A second possible way is to use the sensing means 23. More in detail, when the mobile element 23*a* is brought by the striker 14 (in particular, by cooperating with its transversal protrusion 14*h*) from the normally idle condition to the active condition, the sensitive element 23*b* detects its displacement and signals it to the external control unit of the dishwasher, e.g. through the contacts 72. In this manner, the external control unit receives the signal coming from the sensitive element 23*b* and cuts the current flow through the actuator means 20, in particular the conductive wire 22. In the illustrated embodiments, when the mobile element 23*a* moves into the active condition, the appendix of the latter interacts with the mobile contact of the switch 23*b*, so that the switch 23*b* will generate said signal intended for the external control unit.

The two switches 23*b* and 45 may possibly cooperate with each other, supplying the signal to the external control unit only if both of them are appropriately operated by the mobile element 23*a*, in particular by its terminal appendix, and, respectively, by the locking mechanism 18, in particular by the cursor 36 (e.g. by its protrusion 52). In both of the illustrated embodiments, the switches 23*b* and 45 are adapted to signal the movement of the striker 14 from the retracted condition to the extracted condition (which in this case is indicative of the switching of the door D into the pre-open condition) when they are both open.

When the locking mechanism 18 returns into the locking condition and the striker 14 has moved into the extracted condition, the door D is in the pre-open condition, in which it is sufficiently spaced apart from the access opening O to allow the fluidic communication between the wash chamber WT and the outside environment. The distance between the door D and the access opening O allows the steam generated by the dishwasher W during a wash cycle to escape, thus allowing the crockery contained in the wash chamber WT to dry.

With particular reference to FIG. 7, at the end of the whole working cycle of the dishwasher the user can decouple the door D from the cabinet C by operating the mechanisms situated on the door D to bring the retaining element 16 into the idle position. In this way, the retaining element 16 and the striker 14 of the engagement element 11 will disengage from each other.

Thus, the return means 15 will no longer meet any opposition while returning the striker 14 into the retracted position, since said striker 14 is not constrained to the door D. The return force exerted by the return spring 15 causes the profile 30 carried by the striker 14 (in particular, by the transversal protrusion 14*h*) to abut against the profile 28, in turn carried by the slide 24, so as to generate a thrust transversal to the striker 14. As aforementioned, the return spring 15 is sized in a manner such as to generate a transverse thrust capable of moving the slide 24 backwards by overcoming the countering force exerted by the elastic member 26. When the profile 30 of the striker 14 goes past the profile 28 of the slide 24, the striker 14 can no longer exert said transverse thrust, and therefore the elastic member 26 will return the slide 24 into the locking position, in particular under the striker 14 (FIG. 7).

During the cooperation between the profiles 28 and 30, the backward movement of the slide 24 does not interfere with the position of the cursor 36 and therefore the elastic element 38 is not stressed, in particular thanks to the sliding coupling with some play between them. More in detail, the proximal portion of the cavity 42 moves relative to the head of the mushroom-shaped end 40 without them getting into mutual abutment.

In both of the illustrated embodiments, the cooperation between the slide 24 and the cursor 36 offers the advantage of preventing the conductive wire 22, while the striker 14 is switching from the extracted position to the retracted position, from temporarily loosening from the locking mechanism 18, resulting in a malfunctioning or damaged system 10. In fact, when the striker 14 is brought again from the extracted position to the retracted position by the return means 15, the slide 24 can freely move from the locking position to the unlocking position against the action of the elastic member 26 without interfering with the cursor 36, in particular thanks to the sliding motion with play advantageously allowed between the mushroom-shaped head 40 and the side arms 44. In this manner, the cursor 36 will not be moved backwards and will not loosen the tension of the conductive wire 22, which will always remain under traction.

At the same time, the thrust member 19 will be kept in the extracted condition by the elastic stressing means 21, which will meet no opposition by the locking mechanism 18 or by the striker 14. In this first embodiment, therefore, the locking mechanism 18 does not cooperate with or is constrained to the thrust member 19 directly, but via the striker 14.

The door D can thus be opened further compared to the pre-open configuration, and the washed—and at least partially dried—crockery can be picked up by the user; the process can then be restarted as previous described in order to carry out a new wash cycle.

It must be pointed out that at the end of the cycle the door D can be finally closed by the user, the door abutting against the thrust member 19 and pushing it backwards into the retracted condition, and coupling the striker 14 to the retaining element 16. In the illustrated embodiments, the switching of the thrust member 19 from the extracted condition to the retracted condition is controlled by the backward thrust exerted through the door D as it is pushed shut by the user. Keeping the thrust member 19 in the retracted condition is ensured by the coupling between the striker 14 and the retaining element 16. Said coupling, in fact, holds the door D in abutment with the thrust member 19 through the action of the locking mechanism 18, which prevents the striker 14 from moving relative to the supporting body. This situation corresponds to the operating configuration shown in FIG. 5.

FIGS. 8 to 13 show a system 110 designed in accordance with a second embodiment of the present invention.

Said system 110 is substantially similar to the system 10 designed in accordance with the first embodiment of the present invention. Therefore, details and elements which are similar to—or which perform the same function as—those of the previously illustrated embodiment will be associated with the same alphanumerical references. For brevity, the description of such details and elements will not be repeated below, and reference will be made to the above description of the first embodiment.

For example, the second embodiment of the system 110 differs from the first embodiment of the system 10 for a few aspects relating to the structure, assembly and cooperation of the striker, designated herein as a whole by numeral 114, and of the thrust member, designated herein as a whole by numeral 119.

Unlike the first embodiment, as will be described more in detail hereafter, in this second embodiment the striker 114 can slide from the extracted position to the retracted position while being constrained—for a part of its travel—to the movement of the thrust member 119.

Figure 8:
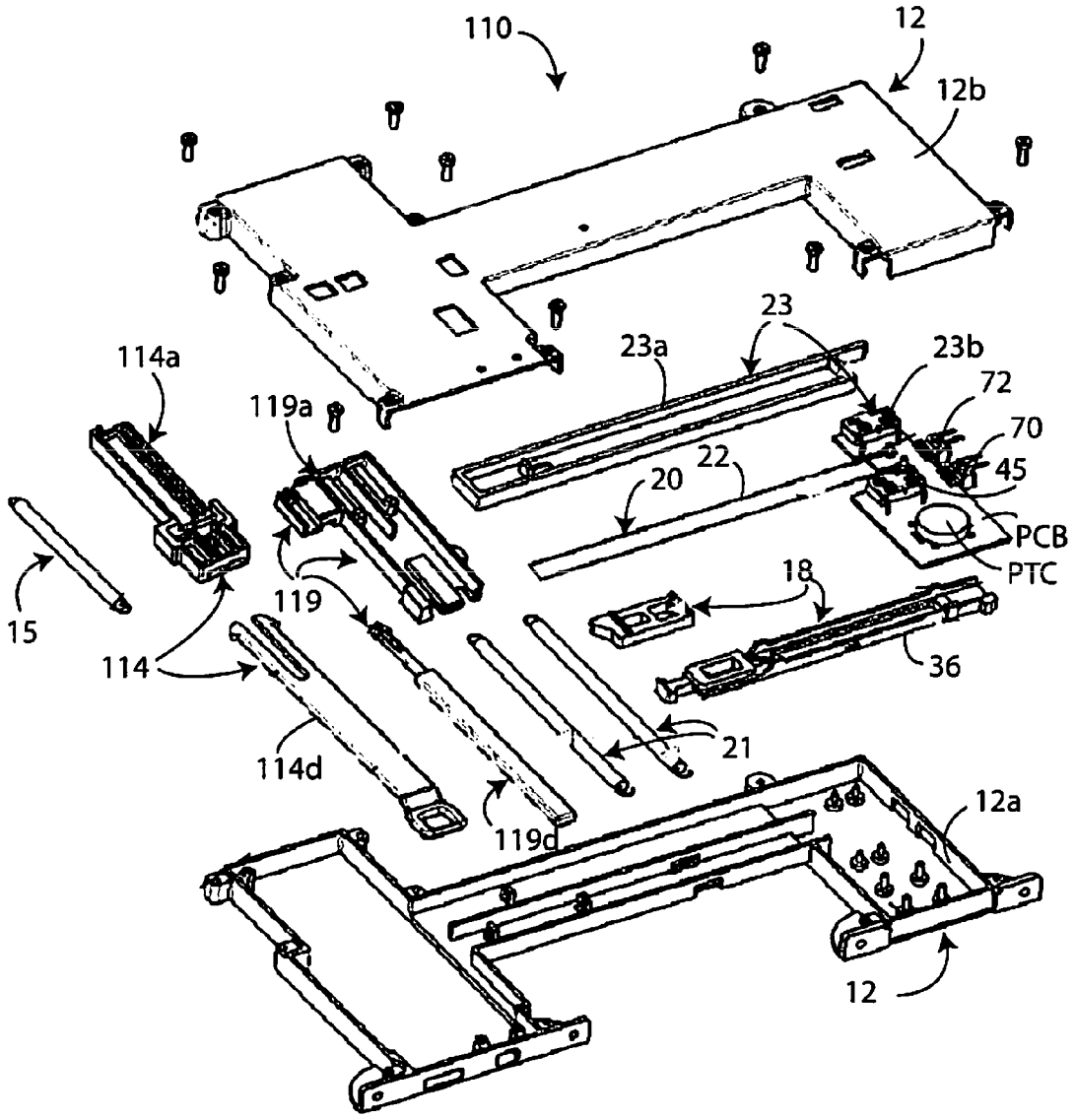
FIG. 8 is an exploded perspective view of a second exemplary embodiment of the system according to the present invention.
Figure 8A:
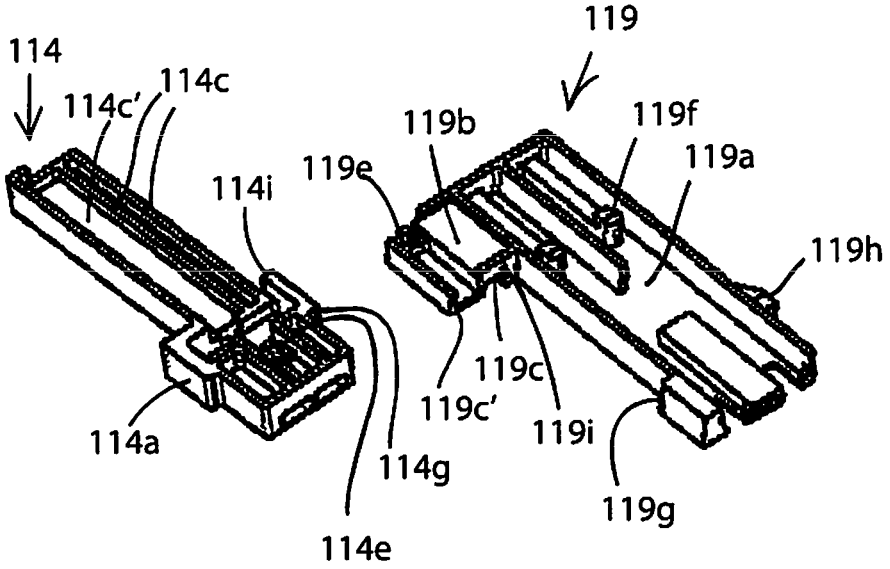
FIG. 8*a* is a perspective view of a set of components of the system shown in FIG. 8.

Unlike the first embodiment, as will be described more in detail hereafter, in this second embodiment the proximal slide 119*a* has a transversal extension 119*b* on which the proximal slide 114 is slideably mounted in the axial direction between the retracted position and the extracted position of the striker 114. With particular reference to FIG. 8*a*, the sliding between the transversal extension 119*b* and the proximal slide 114*a* is substantially of the "skid" type, i.e. the top of the proximal slide 114*a* has a first profile 114*c*, 114*c*' extending axially and coupled to a corresponding second profile 119*c*, 119*c*' also extending axially and carried under the transversal extension 119*b*. Preferably, the first profile has a pair of ribs 114*c* coupled into a cavity 119*c* of the second profile, and a groove 114*c*' in turn coupled to a relief 119*c*' carried by the second profile.

Unlike the first embodiment, as will be described more in detail hereafter, in this second embodiment the optional return spring 15, which advantageously operates by traction, is mounted between a peg 114*e* carried by the striker 114, in particular by its proximal slide 114*a*, and a respective peg 119*e* carried by the thrust member 119, in particular by its transversal extension 119*b*. In particular, the peg 119*e* is carried in a receding channel (not numbered) extending axially on the top of the transversal extension 119*b*.

Unlike the first embodiment, as will be described more in detail hereafter, in this second embodiment the sensing means 23 are adapted to monitor the position of the thrust member 119, and are therefore adapted to provide an indication about the fact that the thrust member 119 is in the extracted position—and hence that the door D is in the pre-open condition.

Unlike the first embodiment, as will be described more in detail hereafter, in this second embodiment illustrated herein the mobile element 23*a* is associated with and pushed by the thrust member 119, e.g. by a transversal protrusion 119*h* thereof, which tends to push the mobile element 23*a* towards the normally idle condition. When the transversal protrusion 119*h*, while the thrust member 119*h* is moving towards the extracted position, goes past the mobile element 23*a*, the latter can move into the active condition.

Unlike the first embodiment, as will be described more in detail hereafter, in this second embodiment the locking mechanism 18 is adapted to act upon the thrust member 119, in particular releasing or holding the transversal protrusion 119*h* carried by the thrust member 119, e.g. by the proximal portion 119*a*. In particular, in this second embodiment illustrated herein the slide 24 cooperates with the thrust member, e.g. with the transversal protrusion 119*h*.

Unlike the first embodiment, as will be described more in detail hereafter, in this second embodiment illustrated herein the slide 24 and the thrust member 119 preferably have respective complementary profiles 28 and 130 cooperating with each other. The profiles 28 and 130 are adapted to allow the thrust member 119 to be forcedly moved, by interference, from the extracted condition to the retracted condition through the action of a user pushing the swiveling door D towards the fully closed configuration.

Unlike the first embodiment, as will be described more in detail hereafter, in this second embodiment illustrated herein the profiles 28 and 130 are respective inclined sections of projecting noses (not numbered) carried by the slide 24 and, respectively, by the thrust member 119, in particular by the transversal protrusion 119*h*. The cooperation between the profiles 28 and 130 takes place in a manner similar to that described for the profiles 28 and 30 of the first embodiment of the system 10, with the difference that in this case such cooperation does not take place automatically through the return means 15, but through the action of a user pushing the swiveling door D into the fully closed configuration.

Unlike the first embodiment, as will be described more in detail hereafter, in this second embodiment illustrated herein the locking mechanism 18 therefore does not cooperate with or is constrained to the striker 114 directly, but via the thrust member 119.

The following will describe the operation of the second embodiment illustrated herein of the system 110 according to the present invention.

Reference will initially be made to the configuration of the dishwasher W with the door D partially open (FIG. 1).

Figure 9:
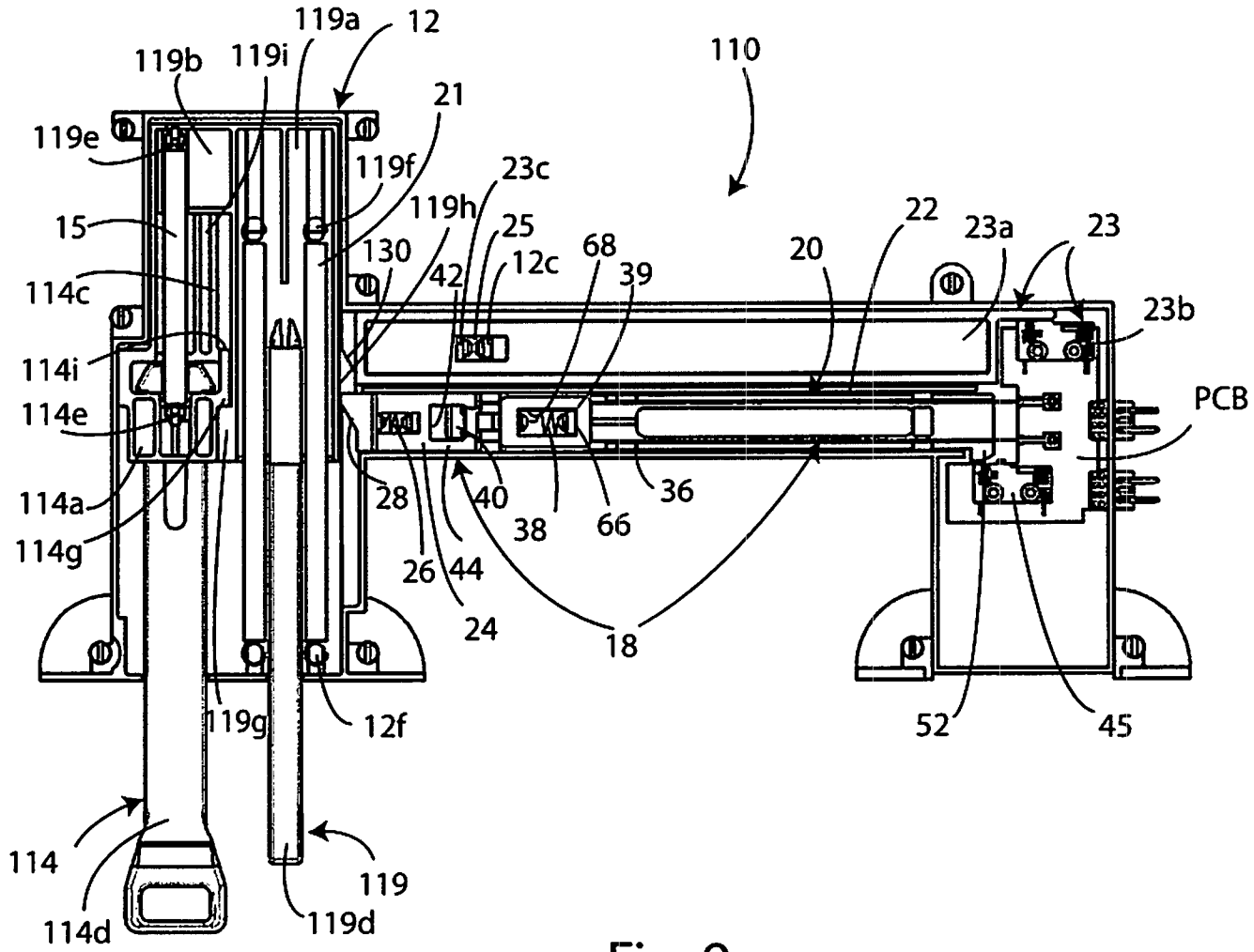
FIGS. 9 to 13 are top views of the system of FIG. 8, shown in a sequence of operating conditions.
Figure 10:
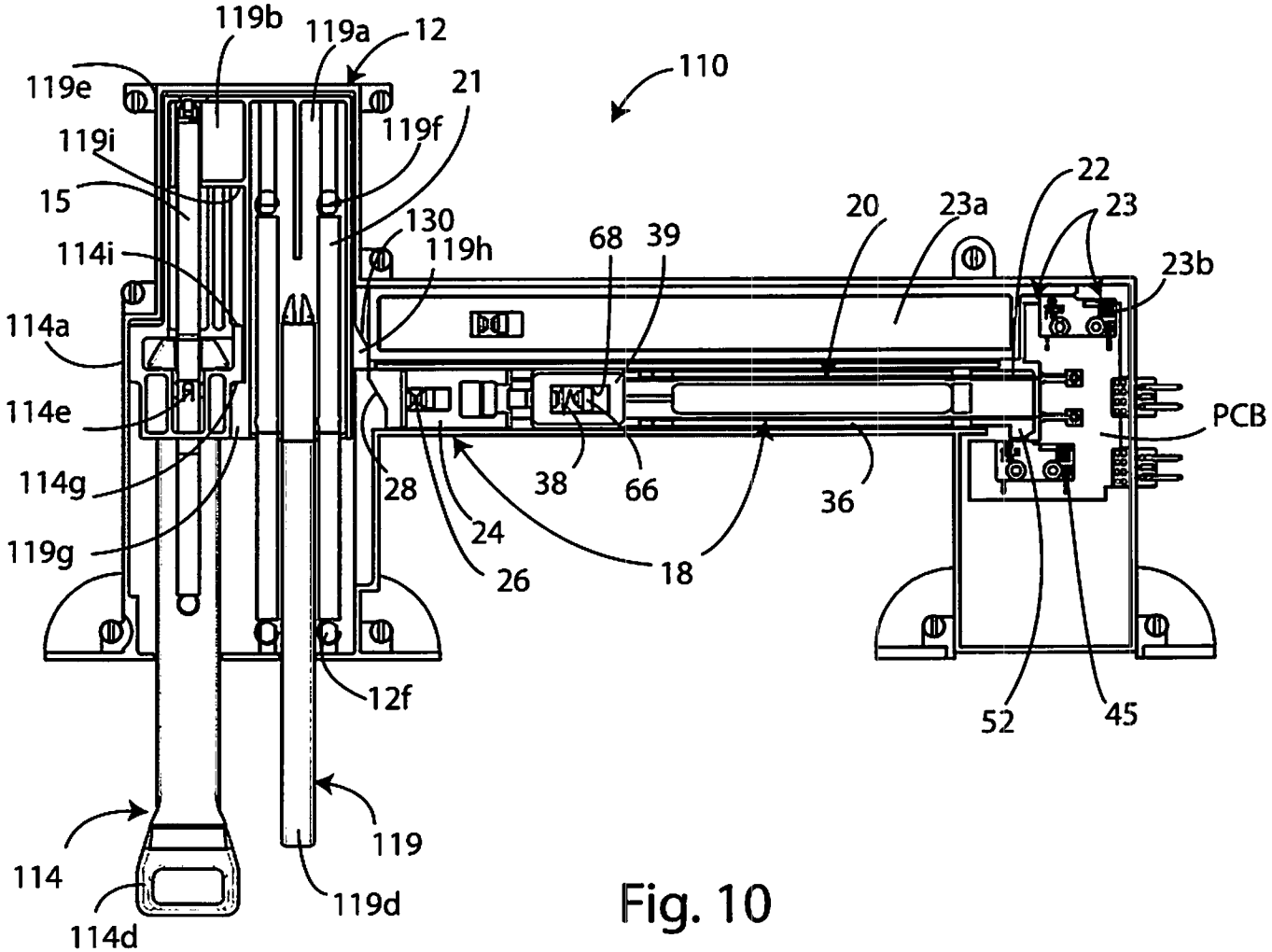
Figure 11:
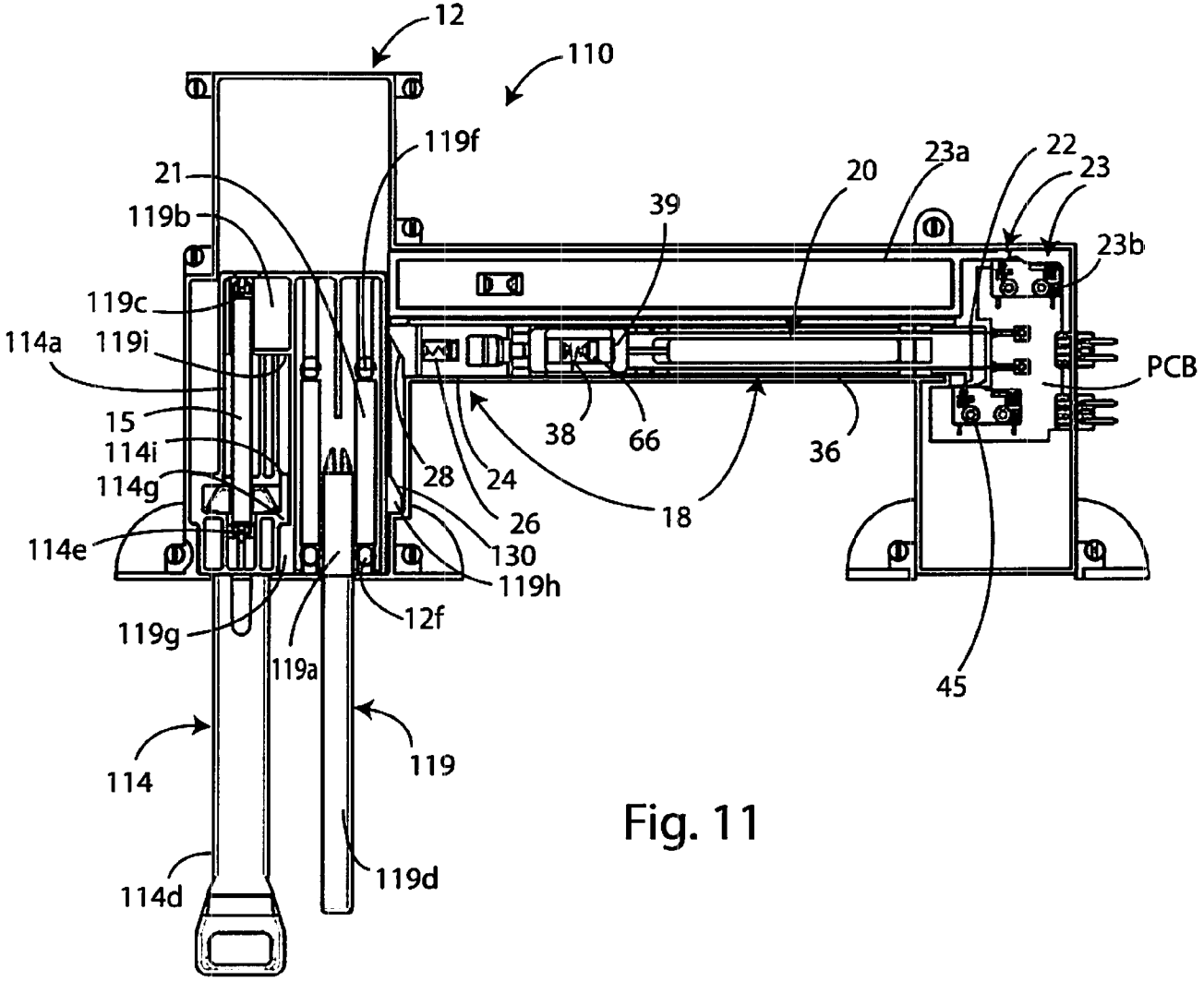

Such a configuration corresponds, in the system 110, to the one shown in FIG. 9, wherein the locking mechanism 18 is arranged in the locking condition, the thrust member 19 is held in the retracted condition by the locking mechanism 18 against the action of the stressing means 21, the striker 114 is in turn held in the retracted position by the return spring 15 and is also constrained to the thrust member 119 due to the abutment of the shoulder 114*g* against the shoulder 119*g*, the actuator member 20 is not electrically energized, and the sensing means 23 detect the retracted position of the thrust member 119. More in detail, the slide 24 is held in the locking position by the elastic member 26, while the cursor 36 is held in the idle position by the elastic element 38. Furthermore, the conductive wire 22 is in the extended condition and is held in traction. Also, the protrusion 119*h* abuts against the slide 24.

In this situation, with the engagement element 11 decoupled from the retaining element 16, the door D can be opened completely by a user, and crockery to be washed can thus be introduced into the wash chamber WT. The user can afterwards program the wash cycle of the dishwasher W by using suitable control interfaces typically provided on the door D.

Let us now consider the action carried out by the user while closing the door D against the cabinet C. During this operation, the retaining element 16 and the striker 114 of the engagement element 11 are brought close to each other and coupled together, by operating a suitable mechanism typically provided on the door D of the dishwasher W.

After said closing action carried out by the user, the door D of the dishwasher W will be fully closed and the engagement element 11 will be in the configuration shown in FIG. 2, coupled to the retaining element 16. Note that the system 110 will always remain in the same configuration with a fully open door (FIG. 9), in that the thrust member 119 will be locked in the retracted condition, differently from the first embodiment illustrated herein (wherein it was brought into the retracted condition only as long as the door D remained in the closed position under the user's action). In this case as well, the striker 114 still behaves like a "dead bolt" holding the door D in the closed position. In this second embodiment, in fact, the striker 114 cannot translate from the retracted position to the extracted position because it abuts against the thrust member 119, which is locked by the locking mechanism 18, in particular through the effect of the abutment of the slide 24 against the transversal protrusion 119*h*.

In such a fully closed configuration of the door D, the engagement element 11 has the striker 114 in the retracted position, the locking mechanism 18 is in the locking condition, the thrust member 119 is locked in the retracted position, the actuator means 20 are not electrically energized, and the sensing means 23 detect the retracted position of the thrust member 119. More in detail, the slide 24 is held in the locking position by the elastic member 26, while the cursor 36 is held in the idle position by the elastic element 38. Furthermore, the conductive wire 22 is in the extended or elongated condition.

Therefore, the wash cycle programmed by the user can be automatically activated by the external control unit of the dishwasher W.

It should now be considered that, at the end of said wash cycle carried out by the washing machine W, the external control unit will send a current impulse to the actuator 20, so as to electrically energize it and bring the locking mechanism 18 into the unlocking condition.

The flow of electric current causes the conductive wire 22 (FIG. 10) to heat up and behave in a manner similar to that already described for the first embodiment.

In this way, the thrust member 119 is released from the locking mechanism 18 and the striker 114 is free to move into the extracted position (FIG. 11) through the effect of the connection with the retaining element 16, which is carried by the door D. Furthermore, the stressing means 21 can exert their thrust action, so as to assist the pre-opening of the door D. In fact, the thrust member 119 contributes to pushing the door D away from the cabinet C against the retaining action of the return means 15, which act upon the striker 114 and tend to hold it in the retracted position.

In this second embodiment, the thrust member 119 is held slidable as a unit one together with the other, from the retracted condition to the extracted condition, with the striker 114, which moves from the retracted position to the extracted position, in particular thanks to abutment of the striker 114 against the thrust member 119 via the shoulders 114*g* and 119*g*. Furthermore, when the striker 114 and the thrust member 119 are in the extracted position or condition, the respective proximal slides 114*a* and 119*a* abut against the walls of the supporting body 12, e.g. against the perimeter of the lower half-shell 12*a*, so that any undesired excessive travel thereof is prevented.

Preferably, the striker 114 and the thrust member 119 are designed to, when they are in the extracted position, protrude further outwards from the supporting body 12 by an extension of a few centimetres (preferably 1 to 3 cm, but in certain conditions of use even more than 5 cm with respect to the normal projection of the striker 114 and of the thrust member 119 when they are in the retracted position or condition); in this way, the movement of the door D away from the access opening O, which is dependent on the above-mentioned extension, will be sufficient to allow the fluidic communication between the wash chamber WT and the environment outside the cabinet C. As in the first embodiment illustrated herein, said extension is approx. 5.5 cm.

Furthermore, when the thrust member 119 goes past the mobile element 23*a*, the sensing means 23 detect the switching of the thrust member 119 into the extracted position, which in this case is indicative of the fact that the door D has reached the pre-open position.

When the electric current impulse supplied by the external control unit stops, the actuator 20 returns into the electrically de-energized condition and the locking mechanism 18 returns into the locking condition.

At this stage, when the electric current impulse has stopped the conductive wire 22 starts cooling down and gradually returns into the extended condition, thus becoming longer and behaving in a way similar to that already described for the first embodiment, so as to return the locking mechanism 18 into a position suitable for getting into the unlocking condition.

Optionally, when the locking mechanism 18 gets into the unlocking condition, it will stop the electric connection between the external control unit and the actuator 20. This occurs in a way similar to that already described for the first embodiment, but in this case the thrust member 119 performs the task of indicating the switching into the pre-open configuration When the locking mechanism 18 returns into the locking condition and the striker 114 has moved into the extracted condition, the door D is in the pre-open condition, in which it is sufficiently spaced apart from the access opening O to allow the fluidic communication between the wash chamber WT and the outside environment. The distance between the door D and the access opening O allows the steam generated by the dishwasher W during a wash cycle to escape, thus allowing the crockery contained in the wash chamber WT to dry.

Figure 12:
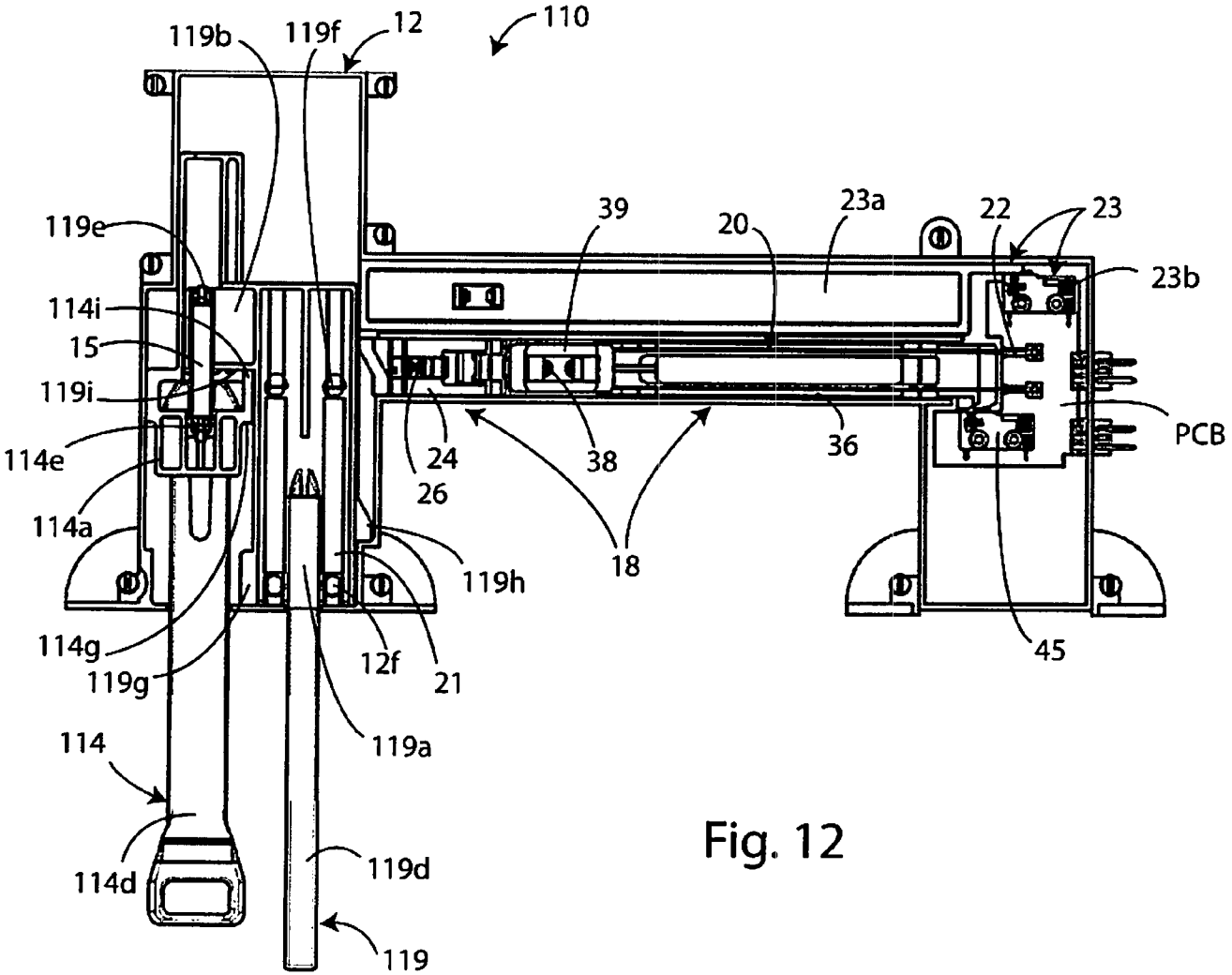

With particular reference to FIG. 12, at the end of the whole working cycle of the dishwasher the user can decouple the door D from the cabinet C by operating the mechanisms situated on the door D to bring the retaining element 16 into the idle position. In this way, the retaining element 16 and the striker 114 of the engagement element 11 will disengage from each other.

However, the return means 15 will meet opposition from the thrust member 119 to returning the striker 114 into the fully retracted position. In fact, the return means 15 are constrained on one side to the thrust member 119, in particular to the proximal portion 119*a* thereof, which is held in its extracted condition by the stressing means 21. In addition, the thrust member 119 preferably carries an additional abutment 119*i*, e.g. carried by the transversal extension 119*b*, which is adapted to abut against a corresponding additional abutment 114*i* carried by the striker 114, e.g. a transversally projecting shelf, so as to create an end-of-travel element that limits the return of the striker 114 into the retracted position when the thrust member is still in the retracted condition. Therefore, in this situation the striker 114 is in an intermediate position between the retracted position and the extracted position, whereas the thrust member 119 is in the extracted condition because the elastic stressing means 21 meet no opposition from the locking mechanism 18 or from the striker 114.

Figure 13:
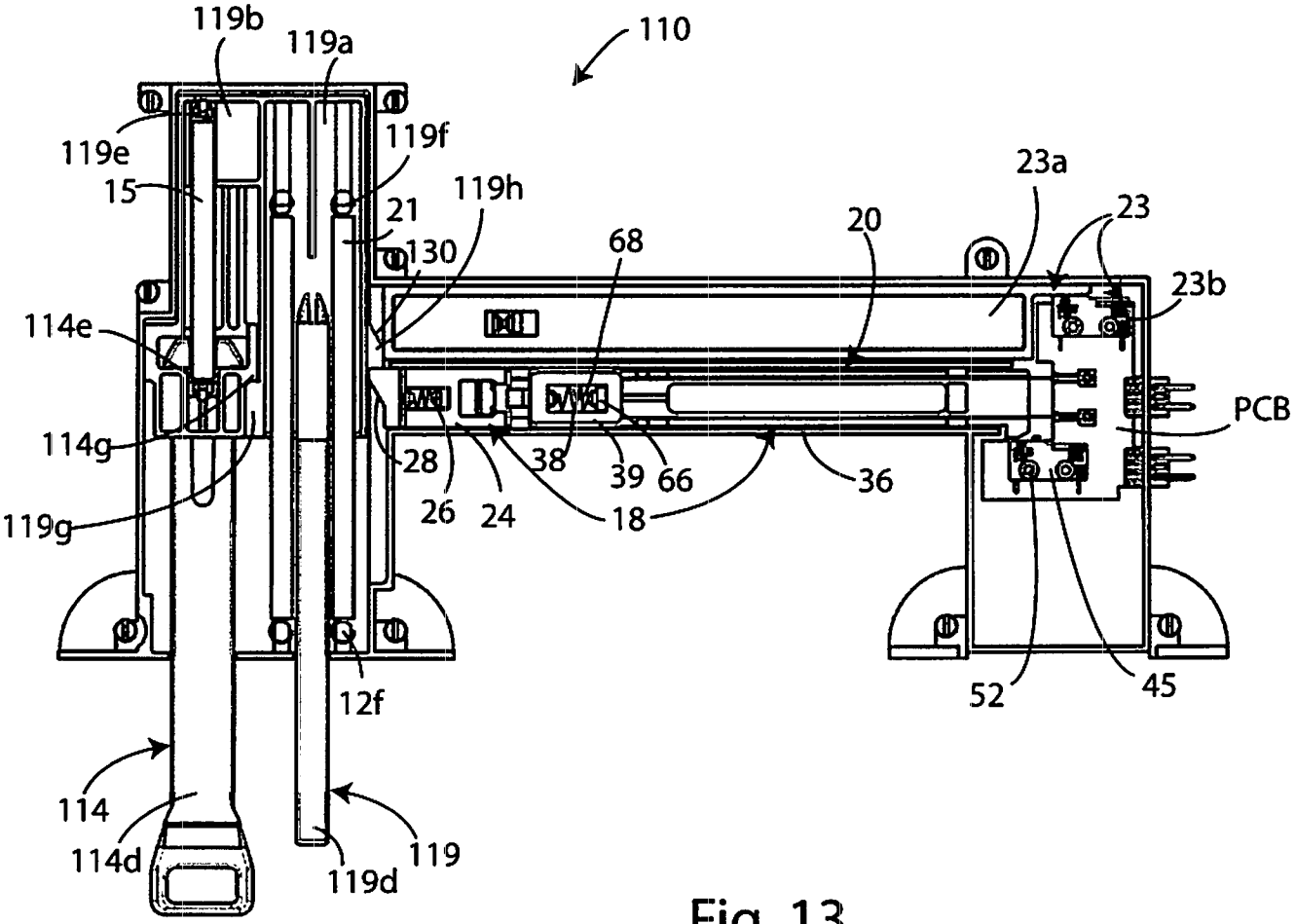

In order to bring the striker 114 and the thrust member 119 again into the respective retracted position and condition, the user can swivel the door D again towards the closed configuration, thereby pushing them further backwards. Thus, the thrust exerted by the door D will first cause an idle travel of the thrust member 119 until the shoulder 119*g* of the thrust member 119 abuts on the shoulder 114*d* of the striker, so as to make the striker 114 slidable as a unit with the thrust member 119 towards the retracted position and condition. Furthermore, during this travel the profile 130 carried by the thrust member 119 (in particular, by the transversal protrusion 119*h*) abuts against the profile 28, in turn carried by the slide 24, so as to generate thereon a thrust which is transversal to the thrust member 119. This action prevails over the countering force exerted by the elastic member 26. When the profile 30 of the thrust member 119 goes past the profile 28 of the slide 24, the thrust member 119 can no longer exert said transversal thrust, and therefore the elastic member 26 will return the slide 24 into the locking position, in particular under the thrust member 119 (FIG. 13).

Similarly to the first embodiment, during the cooperation between the profiles 28 and 30, the backward movement of the slide 24 does not interfere with the position of the cursor 36 and therefore the elastic element 38 is not stressed, in particular thanks to the sliding coupling with some play between them.

In this way, the system 110 will return into the configuration shown in FIG. 9; the door D can then be opened again and brought past the pre-open configuration, and the washed—and at least partially dried—crockery can be picked up by the user; the process can then be restarted as previously described in order to carry out a new wash cycle.

Of course, without prejudice to the principle of the invention, the forms of embodiment and the implementation details may be extensively varied from those described and illustrated herein by way of non-limiting example, without however departing from the scope of the invention as set out in the appended claims.

For example, in less preferred variant embodiments it is conceivable to use a locking mechanism only including the slide and the associated elastic member, omitting the cursor and the associated elastic element. In this configuration, the actuator is adapted to cooperate directly with the slide, e.g. by winding the conductive wire around the latter.

Furthermore, as will be apparent to those skilled in the art reading this description, although both of the embodiments illustrated herein include return means associated with the striker, the presence of such return means is optional and advantageous but should not be considered to be strictly essential for implementing the present invention.

The invention claimed is:

1. System for controlling closing of a door of a household appliance; said door being adapted to close an inner chamber in a cabinet of said household appliance and communicating with an environment outside said cabinet through an access opening; said system comprising an engagement element mounted on said cabinet and adapted to be releasably held by a retaining element mounted on said door, so that said door is constrained to said cabinet when said household appliance is in use;

said engagement element comprises:

a supporting body adapted to be mounted on said cabinet;

a striker adapted to be releasably coupled to said retaining element and to be movably mounted relative to said supporting body between a retracted position and an extended position; when said striker is coupled to said retaining element and assumes said retracted position and said extended position; said door adopting a:

a fully closed condition, in which said door closes fluid-tight said access opening, and, respectively, a pre-open condition, in which said door is spaced from said access opening in a manner such that said door puts said inner chamber in fluidic communication with the environment outside said cabinet;

a locking mechanism, switching between:

an unlocking condition, in which the locking mechanism is adapted to allow releasing said striker, by allowing said striker to move from said retracted position to said extended position when said striker is coupled to said retaining element, and a locking condition, in which the locking mechanism is adapted to hold said striker when said striker is in said retracted position;

an electrically controlled actuator adapted to control the switching of said locking mechanism from said locking condition to said unlocking condition; and a thrust member capable of exerting a thrust in a direction of movement of said striker from said retracted position to said extended position on said door, thereby facilitating switching said door into said pre-open condition when said striker is coupled to said retaining element and said locking mechanism is in the unlocking condition.

2. The system according to claim 1, further comprising means for returning said striker to the retracted position when said striker is decoupled from said retaining element.

3. The system according to claim 2, wherein said means for returning comprise elastic means for urging said striker towards said retracted position.

4. The system according to claim 1, wherein said engagement element includes said thrust member, which is movably mounted relative to said supporting body so as to exert said thrust, thus switching from a refracted condition to an extended condition.

5. The system according to claim 4, wherein said engagement element further comprises elastic stressing means for acting upon said thrust member to bring said thrust member into said extended condition.

6. The system according to claim 4, wherein said striker and said thrust member are mounted one over the other in a mutually guided fashion.

7. The system according to claim 4, wherein said locking mechanism constrains at least one of said striker and said thrust member by preventing said striker from moving towards said extended position and into said extended condition, respectively, when said at least one of said striker and said thrust member is in said retracted position or in said retracted condition, respectively, and said locking mechanism is in the locking condition.

8. The system according to claim 7, wherein said striker and said thrust member are capable of sliding as a unit one together with the other from their respective retracted position or condition to their respective extended position or condition when:

said striker is coupled to said retaining element; and said locking mechanism releases said at least one of said striker and said thrust member by switching from the locking condition to the unlocking condition.

9. The system according to claim 8, wherein said thrust member is made slidable as a unit with said striker when said striker rests on said thrust member.

10. The system according to claim 8, wherein said striker slides relative to the thrust member through the effect of said means for returning along at least a part of the travel from the extended position to the retracted position when said striker is decoupled from said engagement element.

11. The system according to claim 1, wherein said locking mechanism operates in a transversal direction relative to the direction of movement of said at least one of said striker and said thrust member.

12. The system according to claim 1, comprising sensing means for detecting the extended position or condition of at least one of said striker and said thrust member.

13. The system according to claim 12, wherein said sensing means comprise:

a mobile element movable relative to said supporting body in a manner controlled by at least one of said striker and said thrust member, and an indicator member cooperating with said mobile element to provide an indication that said at least one of said striker and said thrust member is in the extended position or condition.

14. The system according to claim 13, wherein said sensing means further comprise elastic countering means for acting upon said mobile element and holding said mobile element in abutment with said at least one of said striker and said thrust member.

15. The system according to claim 1, wherein said actuator controls the switching of said locking mechanism from said locking condition to said unlocking condition when said actuator is energized by electric current flowing therethrough.

16. The system according to claim 15, wherein said actuator is adapted to switch from a normally extended condition to a contracted condition, in which the actuator allows said locking mechanism to get into said locking condition and, respectively, bring said locking mechanism into said unlocking condition.

17. The system according to claim 16, wherein said actuator comprises a shape-memory conductive element mechanically connected to and cooperating with said locking mechanism.

18. The system according to claim 17, wherein said shape-memory conductive element is connected in series with a positive temperature coefficient resistor.

19. Household appliance comprising:

a cabinet having an inner chamber with an access opening through which said inner chamber can communicate with the environment outside said cabinet;

a door adapted to close said access opening, and a system according to claim 1.

* * * * *